US007762655B2

(12) United States Patent
Fairchild et al.

(10) Patent No.: US 7,762,655 B2
(45) Date of Patent: Jul. 27, 2010

(54) PRINTER INK DELIVERY SYSTEM

(75) Inventors: Michael Alan Fairchild, Vancouver, WA (US); Ernest Isreal Esplin, Sheridan, OR (US)

(73) Assignee: Xerox Corporation, Norwalk, CT (US)

( * ) Notice: Subject to any disclaimer, the term of this patent is extended or adjusted under 35 U.S.C. 154(b) by 590 days.

(21) Appl. No.: 11/636,760

(22) Filed: Dec. 11, 2006

(65) Prior Publication Data

US 2008/0136881 A1 Jun. 12, 2008

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | |
|---|---|---|---|
| 5,223,860 | A | 6/1993 | Loofbourow et al. |
| 5,341,164 | A | 8/1994 | Miyazawa et al. |
| 5,442,387 | A | 8/1995 | Loofbourow et al. |
| 5,734,402 | A | 3/1998 | Rousseau et al. |
| 5,784,089 | A | 7/1998 | Crawford |
| 5,861,903 | A | 1/1999 | Crawford et al. |
| 5,917,528 | A | 6/1999 | Grellmann et al. |
| 5,975,690 | A | 11/1999 | Grellmann et al. |
| 6,053,608 | A | 4/2000 | Ishii et al. |
| 6,543,867 | B1 | 4/2003 | Jones |
| 6,561,636 | B1 | 5/2003 | Jones |
| 6,565,200 | B1 | 5/2003 | Jones |
| 6,565,201 | B1 | 5/2003 | Jones |
| 6,572,225 | B1 | 6/2003 | Jones |
| 6,648,435 | B1 | 11/2003 | Jones |
| 6,679,591 | B2 | 1/2004 | Jones |
| 6,705,710 | B2 | 3/2004 | Jones et al. |
| 6,709,094 | B2 | 3/2004 | Jones |
| 6,719,413 | B2 | 4/2004 | Jones |
| 6,739,713 | B2 | 5/2004 | Jones et al. |
| 6,755,517 | B2 | 6/2004 | Jones et al. |
| 6,761,443 | B2 | 7/2004 | Jones |
| 6,824,241 | B2 | 11/2004 | Sonnichsen et al. |
| 6,840,612 | B2 | 1/2005 | Jones et al. |
| 6,840,613 | B2 | 1/2005 | Jones |
| 7,104,635 | B2 | 9/2006 | Jones |
| 2006/0279617 | A1 * | 12/2006 | Korn et al. ..... 347/88 |
| 2007/0296781 | A1 * | 12/2007 | Jones et al. ..... 347/88 |

* cited by examiner

*Primary Examiner*—Matthew Luu
*Assistant Examiner*—Rut Patel
(74) *Attorney, Agent, or Firm*—Maginot, Moore & Beck LLP

(57) ABSTRACT

A solid ink delivery system with discrimination feature for identifying the presence of improper ink sticks for use in solid ink printers for delivering ink to media to form an image thereon is provided. The ink delivery system includes a proper ink stick having a first feature on the stick. The ink delivery system also includes a frame and a guide connected to the frame. The guide guides the sticks in a prescribed path and cooperates with the first feature of the proper ink sticks. The ink delivery system also includes a sensor for sensing the presence of a target surface of a stick at a first position with respect to the frame. The guide cooperates with the first feature of the proper ink sticks to position the target surface of the proper ink sticks in the first position. The guide cooperates with the improper ink sticks to position the target surface of the improper ink sticks spaced from the first position so that proper ink sticks may be distinguished from improper ink sticks.

3 Claims, 27 Drawing Sheets

PRINTER INK DELIVERY SYSTEM

1. TECHNICAL FIELD

The system disclosed herein generally relates to high speed printers which have one or more print heads that receive molten ink heated from solid ink sticks. More specifically, the system relates to improving the ink transport system design and functionality.

2. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages ink sticks which remain in solid form at room temperatures. The ink stock can be refilled by a user by simply adding more ink as needed to the ink loader 110. Separate loader channels are used for the different colors. For, example, only black ink is needed for monochrome printing, while ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink. The ink sticks may likewise be much larger.

In typical prior art solid ink loaders, the ink sticks are positioned end to end in a linear channel or chute with a melt device on one end and a spring biased push block on the other end. This configuration requires the operator to manually advance the ink in the chute to provide space to insert additional ink sticks, to the extent there is capacity in the channel. This configuration may be somewhat cumbersome for loading large quantities of larger ink sticks in newer, larger capacity and faster printing products, as the operator has to repeatedly insert an ink stick and then push it forward manually when loading multiple ink sticks in the same channel.

A loader for a solid ink delivery system should accept the proper ink stick and reject of not permit the entry of an improper ink stick. If the ink stick is too large, it is somewhat simple to prohibit its entry into the chute of the ink delivery system. However, when the ink stick that is improper is smaller than the proper ink stick it becomes more difficult to ensure that the smaller improper ink stick is not inserted into the chute and advanced to the melting unit. Further, for high-capacity, high-volume solid ink printing, the use of large ink sticks is preferred. The use of large ink sticks results in smaller improper ink sticks more easily being placed within the chutes of the ink delivery systems. The system disclosed herein is directed to alleviate some of the aforementioned problems.

3. SUMMARY

In view of the above-identified problems and limitations of the prior art and alternate ink and ink loader forms, the system disclosed herein provides a solid ink supply system adapted for use with solid ink printers.

In one embodiment of the system disclosed herein, a solid ink delivery system with discrimination feature for identifying the presence of improper ink sticks for use in solid ink printers for delivering ink to media to form an image thereon is provided. The ink delivery system includes a proper ink stick having a first feature of the stick. The ink delivery system also includes a frame and a guide. The guide guides the sticks in a prescribed path. The ink delivery system also includes a sensor for sensing the presence of a target surface of a stick at a first position with respect to the guide. The guide cooperates with the first feature of the proper ink sticks to position the target surface of the proper ink sticks in the first position. The guide cooperates with the improper ink sticks to position the target surface of the improper ink sticks spaced from the first position so that proper ink sticks may be distinguished from improper ink sticks.

In another embodiment of the system disclosed herein, a solid ink delivery system with discrimination feature for separating improper ink sticks from proper ink sticks for use in solid ink printers is provided. The proper ink sticks have a first feature on the proper ink sticks. The improper ink sticks do not have the first feature on the improper ink sticks. The delivery system includes a frame and a guide positioned with respect to the frame. The delivery system also includes a sensor for sensing the presence of a target surface of a proper ink stick at a first position with respect to the frame. The guide cooperates with the first feature of the proper ink sticks to position the target surface of the proper ink sticks in the first position. The guide cooperates with the improper ink sticks to position the target surface of the improper ink sticks spaced from the first position so that proper ink sticks may be distinguished from improper ink sticks.

In yet another embodiment of the system disclosed herein, a printer including a delivery system for use with a solid ink stick is provided. The printer includes a ink delivery system for delivering the stick to a melting station for melting the stick so that the ink may be transferred to media to form an image on the media. The ink delivery system has a discrimination feature for separating improper ink sticks from proper ink sticks. The proper ink stick has a first feature on the proper ink stick and the improper ink sticks do not have the first feature on the improper ink sticks. The delivery system includes a frame and a guide positioned with respect to the frame. The delivery system also includes a sensor for sensing the presence of a target surface of a proper ink stick at a first position with respect to the frame. The guide cooperates with the first feature of the proper ink sticks to position the target surface of the proper ink sticks in the first position. The guide cooperates with the improper ink sticks to position the target surface of the improper ink sticks spaced from the first position so that proper ink sticks may be distinguished from improper ink sticks.

The system disclosed herein fundamentally an ink delivery system that may use a driver, for example in the form of a feed belt, to advance solid ink along at least a portion of the feed path from the loading station to the melting station where molten ink can be transferred to one or more print heads. The sensor, which may be one or more sensors, is used to assure that proper ink sticks are utilized in the printer. The sensor target surface, which may be one or more target surfaces, is on the ink stick underside and may be a feature formed in the target surface, such as a protrusion or inset. The guide may be formed into a frame structure, be an active drive element capable of influencing the position of ink sticks, such as a belt the sticks at least partially rest on, or the guide may be one or more rotating or stationary features or attachments coupled to the frame. The guide may be a different element at different locations along the feed portion of the frame, as example a drive belt in one area and a rail in another. The many additional described features of this ink delivery system, which can be selectively incorporated individually or in any combination, enable many additional printer system opportunities, including lower cost, enlarged ink storage capacity, as well as more robust feed reliability.

4. BRIEF DESCRIPTION OF THE DRAWINGS

Features of the system disclosed herein will become apparent to those skilled in the art from the following description with reference to the drawings, in which.

5. DETAILED DESCRIPTION

The term "printer" refers, for example, to imaging or reproduction devices in general, including printers, facsimile machines, copiers, and related multi-function products, and the term "print job" refers, for example, to information including the electronic item or items to be reproduced. References to ink delivery or transfer from an ink form, channel, chute or housing to a print head are intended to encompass the range of intermediate connections, tubes, manifolds, heaters and/or other components and/or functions that may be involved in a printing system but are not immediately significant to the system disclosed herein.

The general components of a solid ink printer have been described supra. The system disclosed herein includes a solid ink delivery system and a solid ink printer and an ink stick for incorporating the same. The printer is generally described as a color printer for convenience. A monochrome version of this printer might have multiple channels of black ink or may have various shades of gray, white or neutral ink in addition to black. The configuration shown and described is a four color, four chute configuration but this could be six or any other practical number, including multiple channels of one or more specific colors. Imaging might be on surfaces atypical of normal printing on or transfer to media, such as directly on products or packaging materials.

Figure 1:
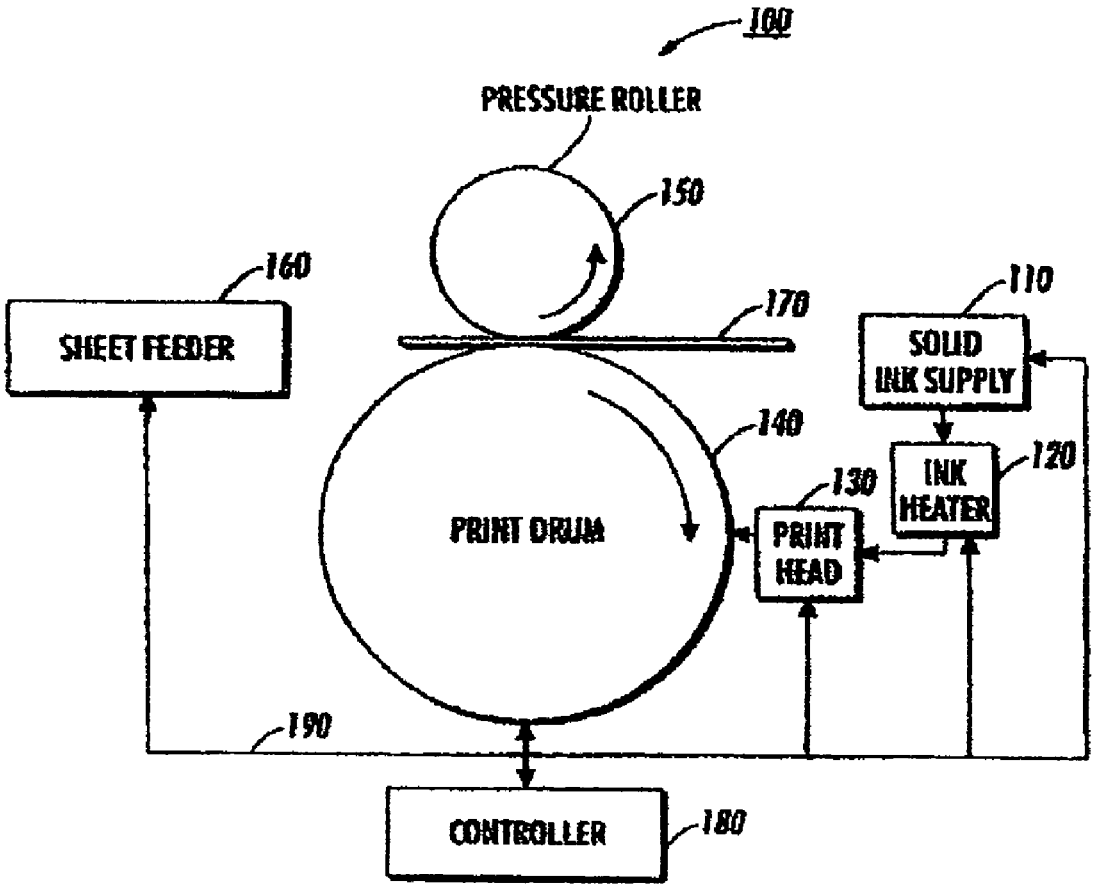
FIG. 1 PRIOR ART
FIG. 1 is a general schematic diagram of a prior art high speed, solid ink printer.
Figure 2:
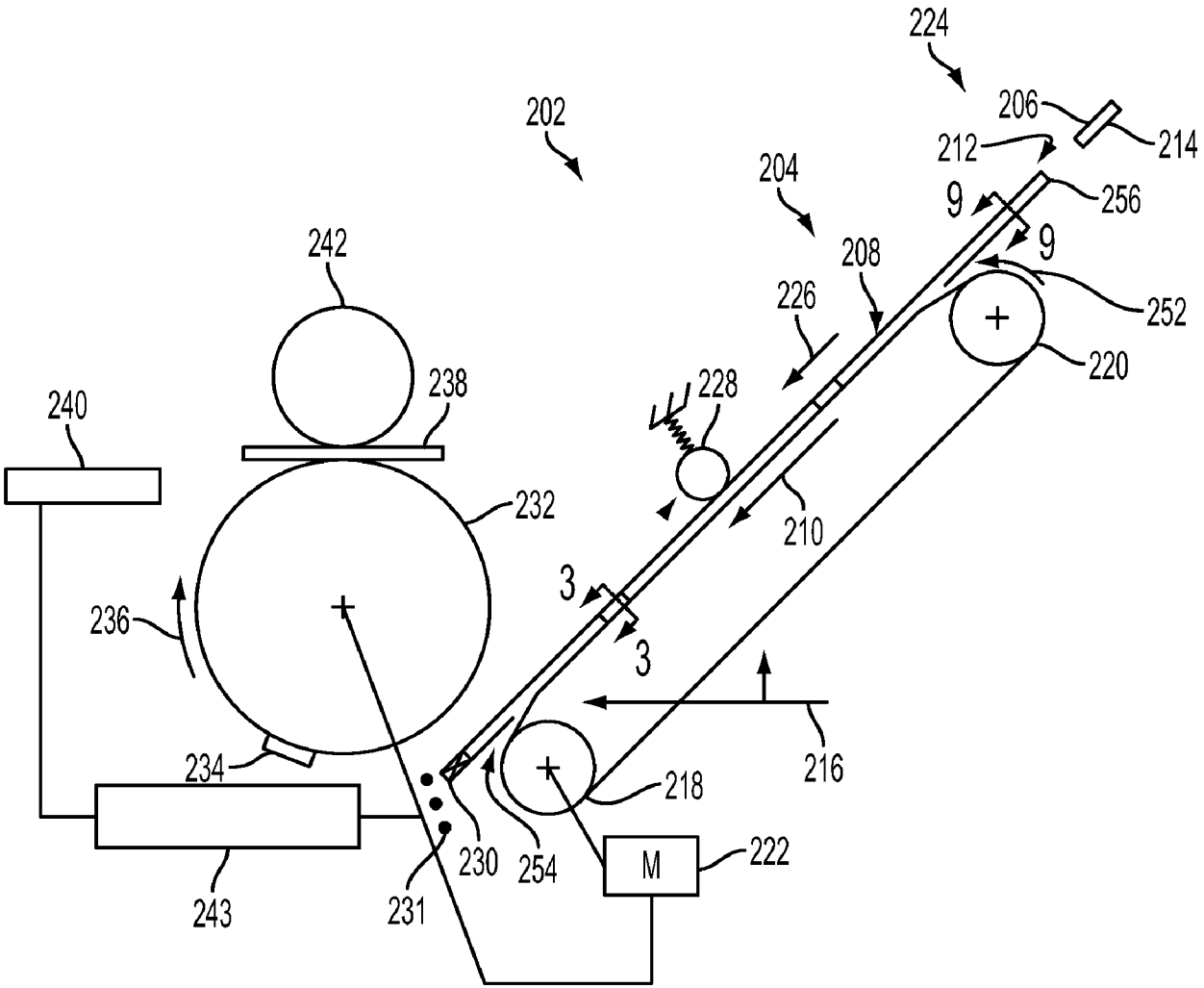
FIG. 2 is a plan view with portions shown as a schematic diagram, of a high speed, solid ink printer with a solid ink delivery system according to the system disclosed herein.

According to the system disclosed herein, and referring now to FIG. 2, a solid ink printer 202 is shown according to the system disclosed herein. The printer 202 includes a delivery system 204 for use with a plurality of ink sticks 206. The solid ink delivery system 204 includes a guide function formed in the chute 208 for guiding the ink sticks 206 in a prescribed path 210. The chute 208 guide may have any suitable configuration to constrain the ink sticks 206. For example, the chute 208 guide features may be walls, ribs, fences or troughs and, as shown in FIG. 2, be generally linear. An opening 212 may be formed in the chute 208 for receiving or inserting the ink sticks 206. The insertion opening 212 may be formed in a secondary component affixed to the chute and may employ size, shape and keying features exclusively or in concert with features of the chute to admit or exclude ink shapes appropriately. For convenience, the insertion and keying function in general will be described as integral to the chute 208.

The solid ink delivery system 204 further includes a drive member 216 for simultaneous engagement with a plurality of the ink sticks 206. The drive member 216, as shown in FIG. 2, extends along a substantial portion of the prescribed path 210 of the guide 208. The drive member 216 may have any suitable size and shape and may, as shown in FIG. 2, be in the form of a belt. The belt 216 may, as shown in FIG. 2, be held taut by a pair of spaced apart pulleys in the form of a drive pulley 218 and at least one idler pulley 220. The drive pulley 220 may be rotated by any suitable device, for example by a motor transmission assembly 222.

Referring to FIG. 2, the operation of the solid ink printer 202 is shown schematically. The ink sticks 206 are loaded into the insertion opening 212 area of the chute 208 of the solid ink delivery system 204. The drive member belt 216 of the solid ink delivery system 204 advances the sticks 206 from loading station 224 in the direction of arrow 226. The chute 208 is configured to contain and guide the sticks along the feed path from insertion to melt unit.

As is shown in FIG. 2, the direction of arrow 226 of the ink sticks 206 is in a downward direction. In such orientation, the ink sticks 206 may have a tendency to slide and advance past the belt 216 due to the effects of gravity. To alleviate this issue, a nudging member 228 may be positioned along the chute 208 to push or nudge the sticks 206 into sufficient contact with the belt 216 to prevent gravity from causing the sticks 206 to slip away from the belt 216. The sticks 206 move along path 210 in the direction of arrow 226 and advance to melting station 230 where the ink sticks 206 are converted into a liquid 231.

The liquid 231 is jetted upon a print drum 232 to form an image 234. The image 234 advances in the direction of arrow 236 where sheets 238 from a sheet feeder 240 combine with the image 234. The image 234 is imprinted onto the sheet 238 with the assistance of a pressure roller 242. A printer controller 243 sends signals to the motor transmission assembly 222, the sheet feeder 240 and the print drum 232 to control the operation of the printer 202.

Figure 3:
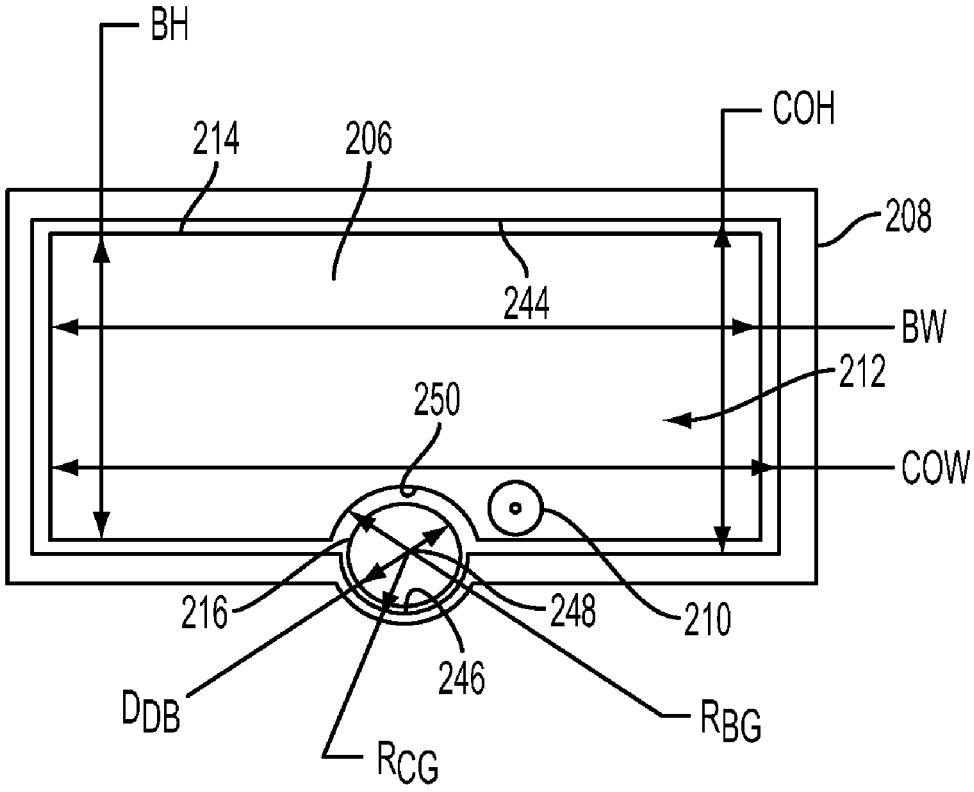
FIG. 3 is a cross sectional view of the solid ink delivery system of FIG. 2 along the line 3-3 in the direction of the arrows.

The ink stick 206 is shown in FIG. 2 positioned in the opening 212 of the guide or chute 208. The stick 206 and the chute 208 may have any suitable shape. For example, as is shown in FIG. 3, for simplicity stick periphery 214 may have a generally rectangular shape and may be defined by a width BW and a height BH. Ink sticks for the system disclosed herein have a periphery underside, the underside being defined as the lower surface periphery directed by gravity or other influence toward or in close proximity to the guide, whether or not supported, guided and/or otherwise influenced by the guide. The underside may have a three dimensional topography and has an inset guide or drive engagement feature 250, such as a groove, which engages the guide 216. The guide may be in various forms at different locations along the feed path, such as rotational, stationary or a drive element.

Since the sticks 206 move within the chute 208, the opening 212 in the chute 208 may, for simplicity, be likewise rectangular and have a size slightly larger than that of the sticks 206. For example, the opening 212 may have a chute opening width COW which is slightly larger than the stick width BW. Similarly, the chute may have a chute opening height COH which is slightly larger than the stick height BH. The chute 208 includes an internal periphery 244 for shape cooperation with the external periphery 214 of the stick 206.

The internal periphery 244 of the chute 208 includes a chute belt guide 246 for guiding the drive belt 216 along its path 210. The chute belt guide 246 of chute 208 may, as shown in FIG. 3, have a generally semi-circular cross section defined by radius $R_{CG}$ extending from origin 248. The stick 206 may include a drive engagement feature 250 which, as is shown in FIG. 3, may have a generally semi-circular cross section defined by radius $R_{BG}$ extending from origin 248.

Alternatively, the drive belt 216 and the stick belt guide 250 may have any suitable shape and consequently any suitable shape or cross section. As is shown in FIG. 3, the belt 216 may, for simplicity, have a circular cross section defined by diameter $D_{DB}$. The radius $R_{CG}$ of the chute belt guide 246 and the radius $R_{BG}$ of the stick belt guide 250 may be selected such that the drive belt 216 may be contained within the chute belt guide 246. The stick belt guide 250 constrains the sticks 206 on the drive belt 216 such that the sticks 206 engage with the belt 216 to properly advance the sticks 206 in the chute 208.

At least a portion of the belt 216 should be contained within the chute 208 and contact the stick 206 over at least a portion of the ink stick travel range. The stick belt guide 250 may be positioned anywhere along the periphery 212 of the sticks 206. Similarly, the chute belt guide 246 may be positioned along the periphery 244 of the chute 208 in any position. The belt 206 may be centrally positioned within the chute 208 to optimally advance the sticks 206 in the chute 208. Placement of the belt guide in the chute and guide feature in the ink stick will be complementary relative to the described perimeter shapes for a given chute and the proper sticks for that chute.

For example, and as shown in FIG. 3, the chute belt guide 246 is centrally positioned in the chute 208 to receive the belt 216. Similarly the stick belt guide 250 may be centrally positioned relative to the stick 206.

In order that the ink stick 206 can slide smoothly along the chute 208, potential contact surfaces of the chute 208 should be made of a material that provides a coefficient of friction between the internal periphery 244 of the chute 208 and the external periphery 214 of the sticks 206 that is low enough to permit the easy flow or movement of the sticks 206 in the chute 208. Conversely, the coefficient of friction between the periphery 244 of the chute 208 and the belt 216 should be sufficiently low to permit the advancement of the belt 216 within the chute belt guide 246 of the chute 208. The coefficient of friction between the belt 216 and the sticks 206 should be sufficiently high to cause the belt 216 to engage the sticks 206 and to cause the belt 216 to properly advance the sticks 206 along the chute 208. Friction values are not definite and will vary based on numerous factors of a given system, such as stick size, stick to stick interfaces, angle of travel relative to gravity and so forth.

Referring again to FIG. 2, the belt 216 advances into the chute 208 from belt guide inlet opening 252 to the chute belt guide 246. The belt 216 exits the chute belt guide 246 at belt guide outlet opening 254. The belt 216 then is received by the drive pulley 218 and advanced toward the idler pulley 220. The belt 216 then reenters the belt guide inlet opening 252. The progressive position of the drive pulley 218 and idler pulley 220 or pulleys relative to the belt travel direction can be in any order appropriate to the chute and drive system configuration.

Additional ink sticks may be installed or loaded into the solid ink delivery system either from end 256 of the chute 208 or in a direction normal to the end 256 of the chute 208. For simplicity, the ink sticks 216 are preferably loaded proximate the end 256 of the chute 208.

It is important that the proper ink stick be loaded into the appropriate chute of the machine. To assure the loading of proper ink sticks, keyed stations are utilized to permit the entry of the proper ink stick and to prohibit the entry of an improper ink stick. This is particularly valuable on color machines where typically four separate sticks of different colors are to be loaded into the same machine. Different models may use sticks of different composition or sticks marketed under different programs and so improper sticks include wrong colors for a given chute and wrong ink stick SKU's for a particular model. Smaller sticks that would not be excluded by insertion opening keying features likewise need to be differentiated from proper sticks.

Figure 4:
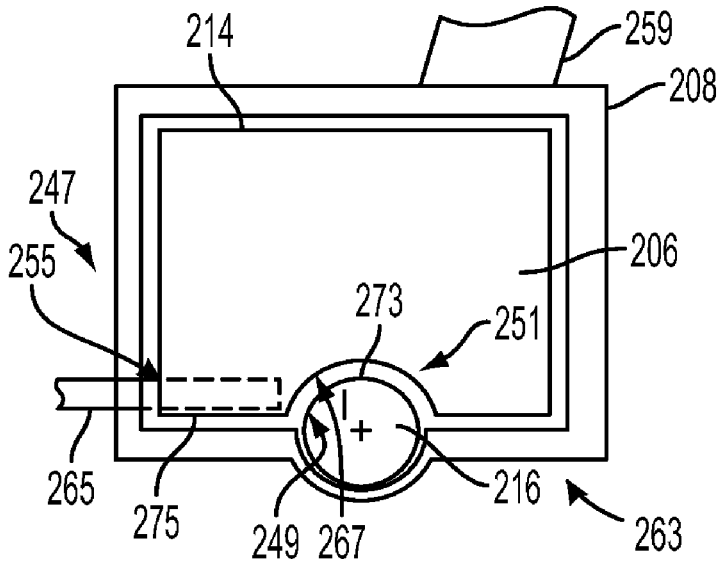
FIG. 4 is a partial end view, partially in cross section, of the chute of the solid ink delivery system of FIG. 2 with a mechanical sensor showing the cooperation of the belt and chute with a proper ink stick.

According to the system disclosed herein and referring now to FIG. 4, a stick validation system 247 for use in a solid ink delivery system of a printer is shown in greater detail. The solid ink delivery system includes, as shown in FIG. 4, a delivery system discrimination feature 249 which cooperates with a proper stick discrimination feature 251 on the proper stick 206. The stick validation system 247 assists in identifying the presence of the proper ink stick 206. The solid ink delivery system stick validation system 247 further identifies the presence of an improper ink stick 253 (see FIGS. 6 and 7). This illustration depicts a single side sensing means at a particular location in the chute. It should be noted that multiple sensors may be used and multiple sensing surfaces or features on the ink stick may be present on either or both sides of the guide and that all such variations are encompassed by the system disclosed herein.

The stick validation system 247, as shown in FIG. 4, includes the proper ink stick 206 which includes the first feature or discrimination feature 251. The proper ink stick 206 further includes a target surface 255 located on periphery 214 of the proper ink stick 206. The solid ink delivery system stick validation system 247 further includes a frame 259. The stick validation system 247 further includes a guide 263. The guide 263 is connected to the frame 259. The guide 263 guides the proper ink stick 206 in prescribed path 210 (see FIG. 3).

The stick validation system 247 further includes a sensor 265. The sensor 265 is utilized to sense the presence of target surface 255 of the stick 206 at a first position 267 with respect to the frame 259. The guide 263 cooperates with the discrimination feature 251 located on periphery 257 of the proper ink sticks 206 to position the target surface 255 of the proper ink stick 206 in the first position 267. Note that the sensor 265 is proximate the chute. This close proximity is intended to apply to any aspect of a sensor configuration that may be employed, including a sensor flag where a portion of the flag and the sensor upon which it acts may be positioned more remotely. In this case, a portion of the sensor flag, or any such sensor member, is proximate the chute such that it is able to interact with the target surface 255 of the stick 206.

Figure 6:
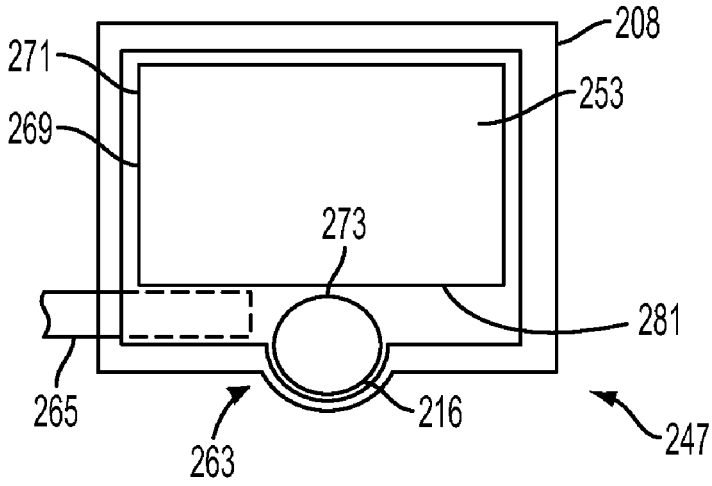
FIG. 6 is a partial end view, partially in cross section, of the chute of the solid ink delivery system of FIG. 2 showing the cooperation of the belt and chute with an improper ink stick.

Referring now to FIG. 6, the guide 263 cooperates with periphery 269 of improper ink sticks 253 to position target surface 271 of the improper ink sticks 253 spaced from the first position 267 (see FIG. 4) so that proper ink sticks 206 may be distinguished from improper ink sticks 253.

Referring again to FIG. 4, the guide 263, as shown in FIG. 4, includes the drive member 216 in the form, as shown in FIG. 4, of a belt. The belt 216 is moveably positioned with respect to the frame 259. The belt 216 engages with a first or a stick discrimination feature 251 of the proper stick 206. As shown in FIG. 4, the stick discrimination feature 251 is in the form of a longitudinal groove formed in periphery 257 of the stick 206.

Referring again to FIG. 4, the groove 251 of the proper stick 206 receives belt 216. The upper surface 273 of the belt 216 is positioned above lower face 275 of periphery 257 of the stick 206. The sensor 265 is positioned and secured to the frame 259 or the chute 208 such that the sensor 265 is positioned below upper surface 273 of the belt 216 and above lower surface 275 of the proper stick 206. Thus the sensor 265 is in position with target surface 255 of proper stick 206.

The sensor 265 may be any suitable sensor and may, for example, be a mechanical sensor or an electronic sensor. The sensor 265 may be in the form of a proximity switch. It should be appreciated that for simplicity and to reduce cost, the sensor 265 may be in the form of a mechanical sensor. The sensor 265 may be in the form of a mechanical flag and may transition electronically or magnetically or may actuate a purely mechanical switch transition.

Figure 5:
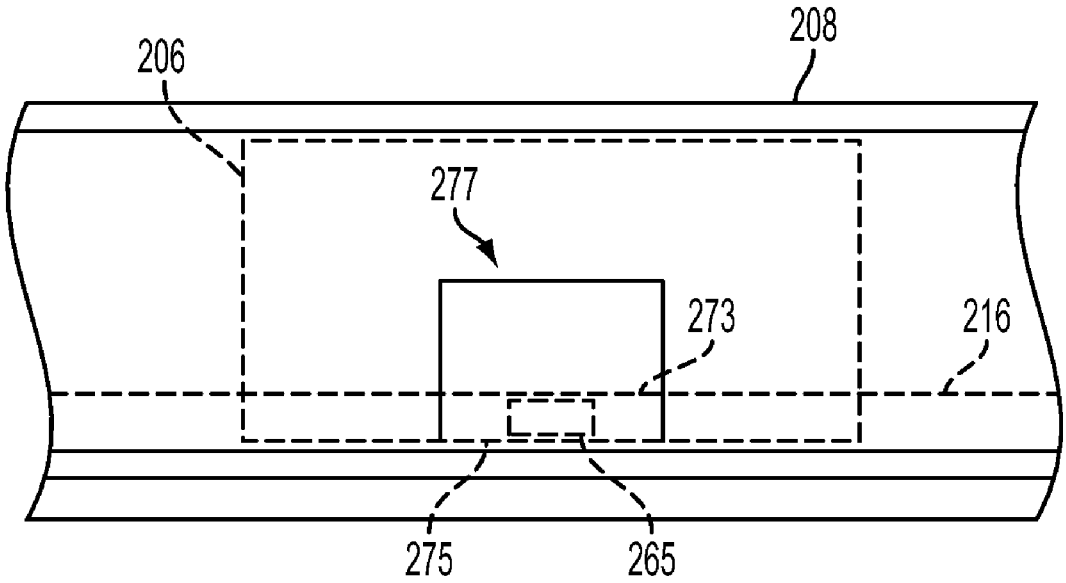
FIG. 5 is a partial plan view, partially in cross section, of the chute of FIG. 4.

Referring now to FIG. 5, the sensor 265 is shown in position relative to belt 216 and proper stick 206 in the chute 208.

As shown in FIG. 5, the chute 208 may include a window or opening 277 for permitting the sensor 265 to contact the stick 206. As shown in FIG. 5, the sensor 265 is positioned above lower face 275 of the stick 206 and below upper surface 273 of the belt 216.

Figure 7:
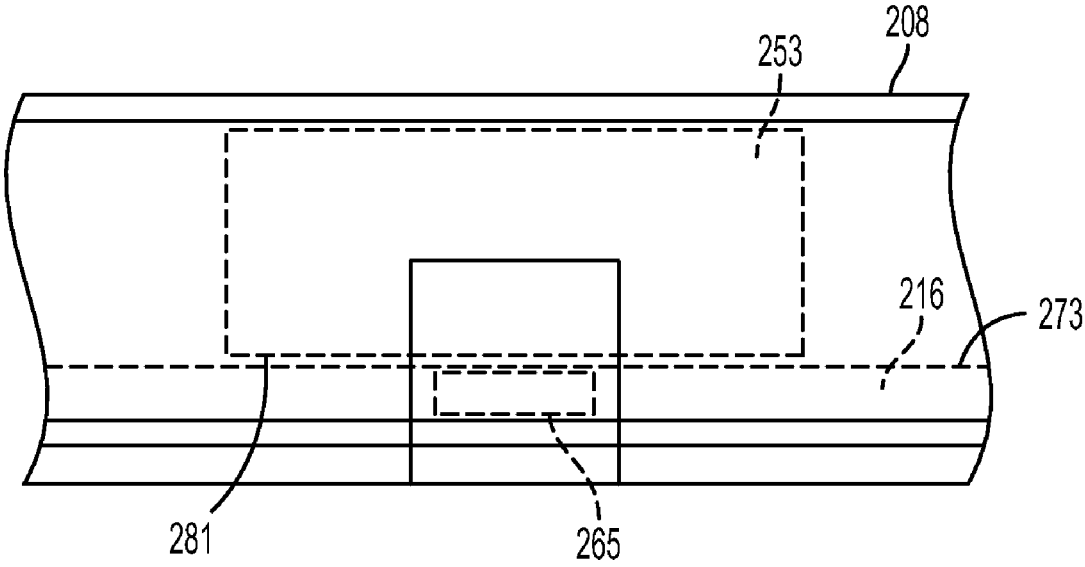
FIG. 7 is a partial plan view, partially in cross section, of the chute of FIG. 6.

Referring now to FIGS. 6 and 7, an improper ink stick 253 is shown in the chute 208 of a solid ink delivery system of an ink printer. The stick 253, as shown in FIGS. 6 and 7, may be, for example, a generally rectangular cross-section and does not include the stick discrimination feature 251 of proper ink stick 206. It should be appreciated that a variety of shapes of sticks without the discrimination feature may be rejected by the sensor 265. The stick 253 includes a lower surface 281 which, as shown in FIGS. 6 and 7, is contacted by upper surface 273 of the drive member 216. Since the upper surface 273 of the drive member 216 is positioned above sensor 265, the lower surface 281 of improper ink stick 253 is likewise positioned above sensor 265. Thus, the sensor 265 does not contact the improper stick 253 and, thus, indicates that an improper stick and not the proper ink stick 206 is in position in the chute 208 of the solid ink delivery system of the ink printer.

Figure 8:
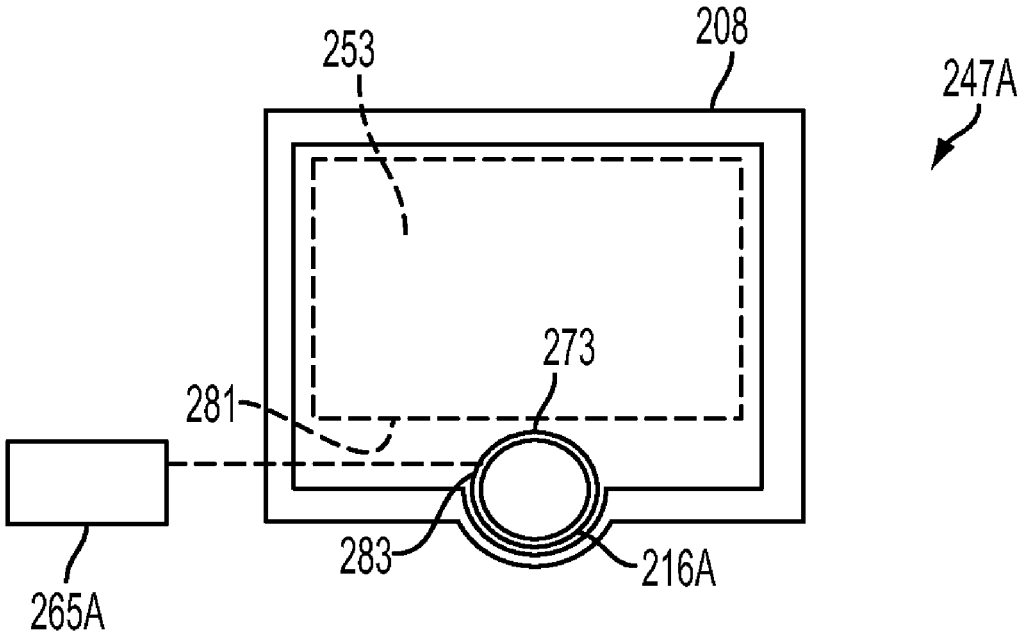
FIG. 8 is a partial end view, partially in cross section, of another embodiment of the system disclosed herein in the form of a chute with an electronic sensor showing the cooperation of the belt and chute with an improper ink stick.

According to the system disclosed herein and referring now to FIG. 8, another embodiment of the system disclosed herein is shown as stick validation system 247A for use with a solid ink delivery system for use in a printer. The stick validation system 247A is similar to the stick validation system 247 of FIGS. 4, 5, 6, and 7 except that the stick validation system 247A includes a sensor 265A which is not a mechanical sensor. The sensor 265A of the stick validation system 247A, of FIG. 8, is an optical sensor and cooperates with a reflective surface 283 formed on, for example, drive member or belt 216A of the solid ink delivery system. A similar alternative, not shown, is an appropriately angled or configured portion of the lower ink stick surface that reflects the beam from an optical sensor or that blocks a beam from an optical sensor, in either case determining that the target surface interacting with the sensor exists or is not present so that proper ink sticks may be recognized.

As shown in FIG. 8, an improper ink stick 253 is shown positioned in chute 208. Lower surface 281 of the improper ink stick 253 is positioned above upper surface 273 of the belt 216A such that the optical sensor 265A may send and receive a reflective signal to the reflective surface 283 of the belt 216A, thus, indicating that an improper stick 253 is in position in chute 208.

Figure 9:
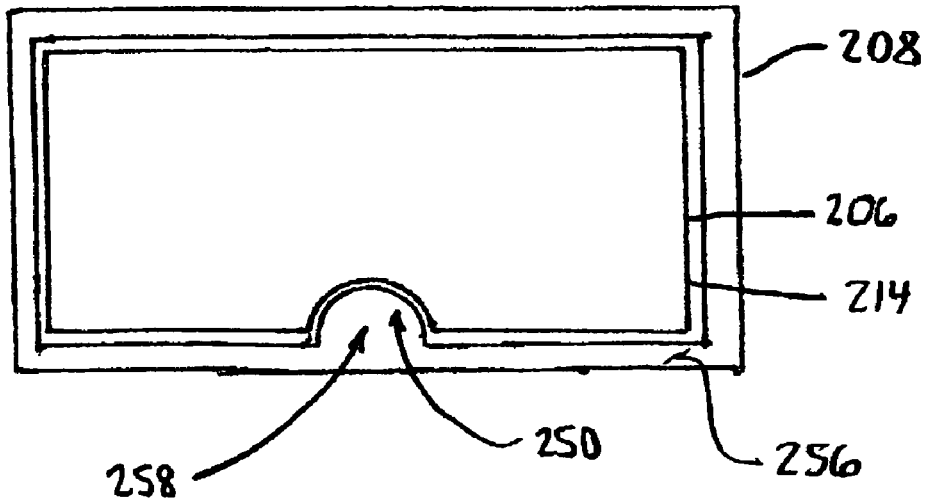
FIG. 9 is a cross sectional view of the solid ink delivery system of FIG. 2 along the line 9-9 in the direction of the arrows.

For example, and as is shown in FIG. 9, the stick belt guide 250 formed in the periphery 214 of the stick 206 may be utilized as an insertion or feed keying device for the stick 206. The chute 208 includes a chute key 258 positioned in end 256 of the chute 208 that aligns with the stick belt guide 250 of the sticks 206. The chute key 258 only permits an ink stick such as stick 206 with stick belt guide 250 to fit correctly into the chute 208.

Figure 10:
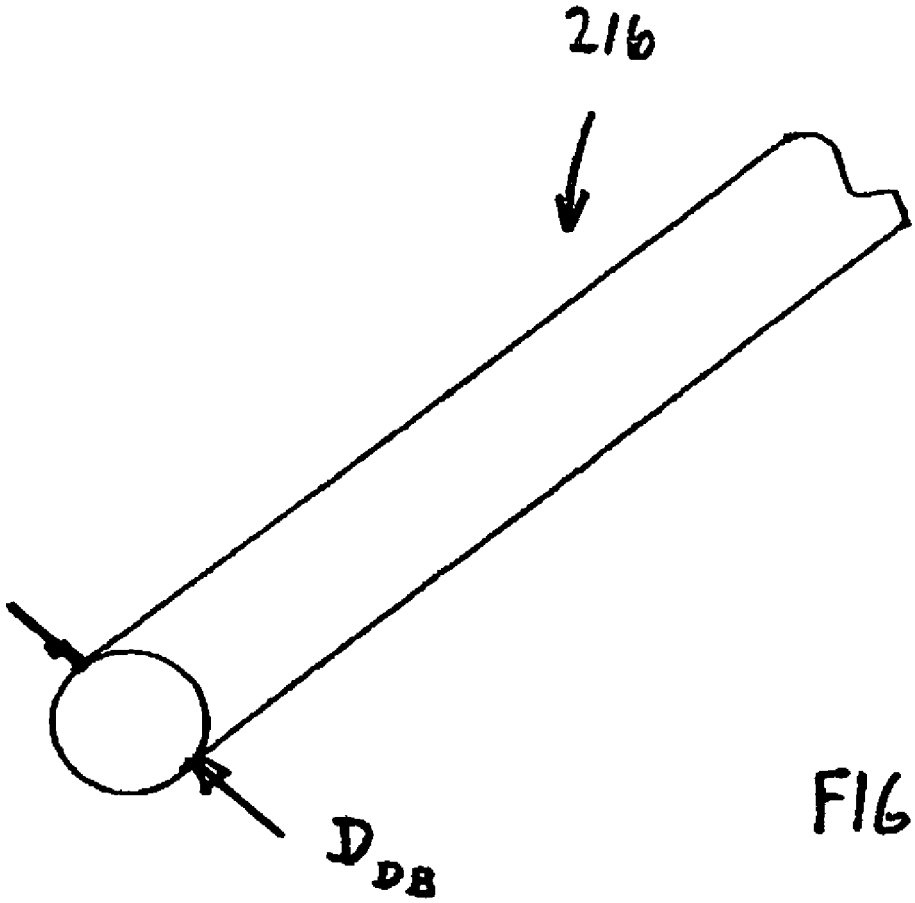
FIG. 10 is a partial perspective view of the drive member of the solid ink delivery system of high speed, solid ink printer of FIG. 2.

Referring now to FIG. 10, the belt 216 is shown in greater detail. The belt 216 may have a constant diameter defined by diameter $D_{DB}$ and may be sized to properly advance the sticks. The belt 216 may be made of any suitable, durable material. For example, the belt 216 may be made of a plastic or elastomer. If made of an elastomer, the belt 216 may be made of, for example, polyurethane.

Figure 11:
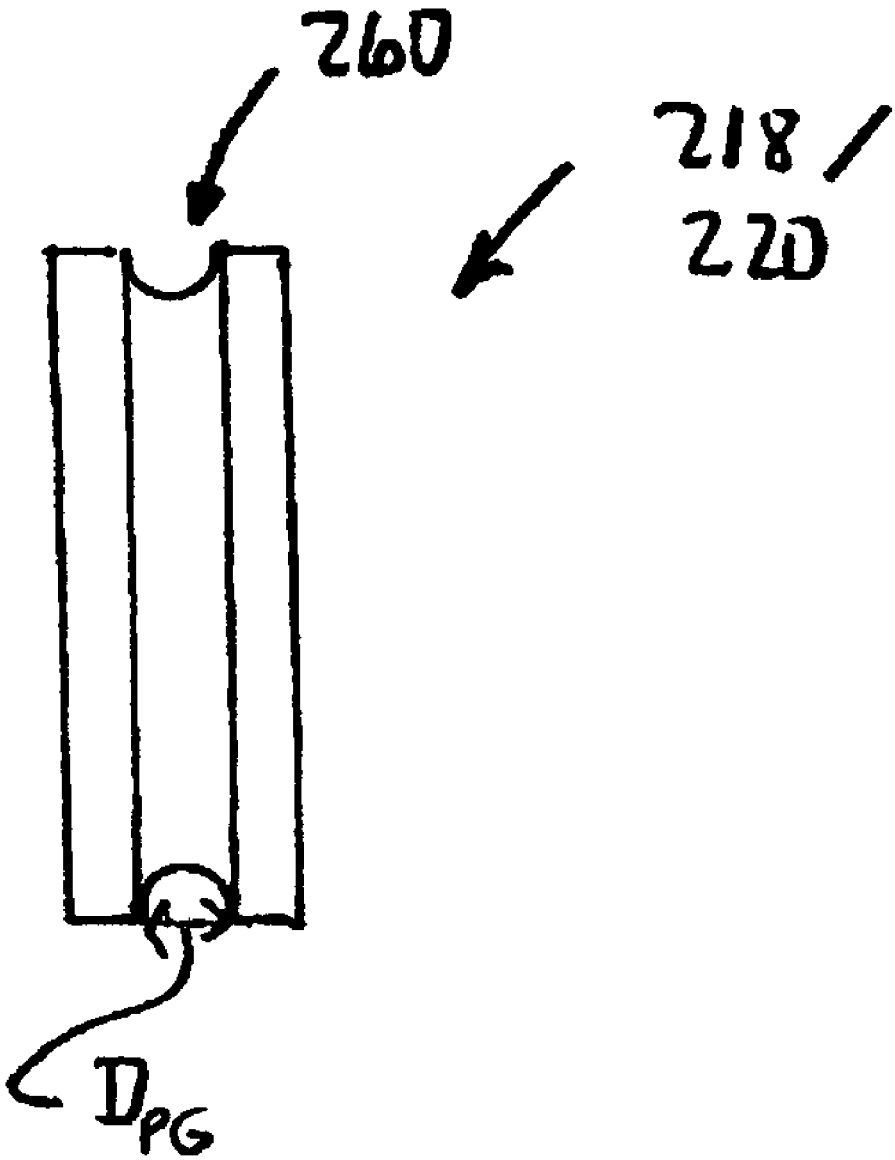
FIG. 11 is a plan view of a pulley for supporting the drive member of FIG. 10.

Now to FIG. 11, pulley 218 and pulley 220 are shown in greater detail. The pulleys 218 and 220 have a similar size and shape and may include a pulley groove 260 for receiving the belt 216. The pulley groove 260 may be defined by a diameter $D_{PG}$ and have a diameter similar to that of the diameter $D_{DB}$ of the belt 216 (see FIG. 10). The pulleys 218 and 220 are made of any suitable, durable material and may, for example, be of a plastic. If made of a plastic, for example, the pulley may be made of glass filled nylon or Acetyl. The pulley groove may be configured with a "V" shape or other suitable form that functions with the particular belt being used, likewise the underside inset guide feature or groove of proper ink sticks.

Figure 12:
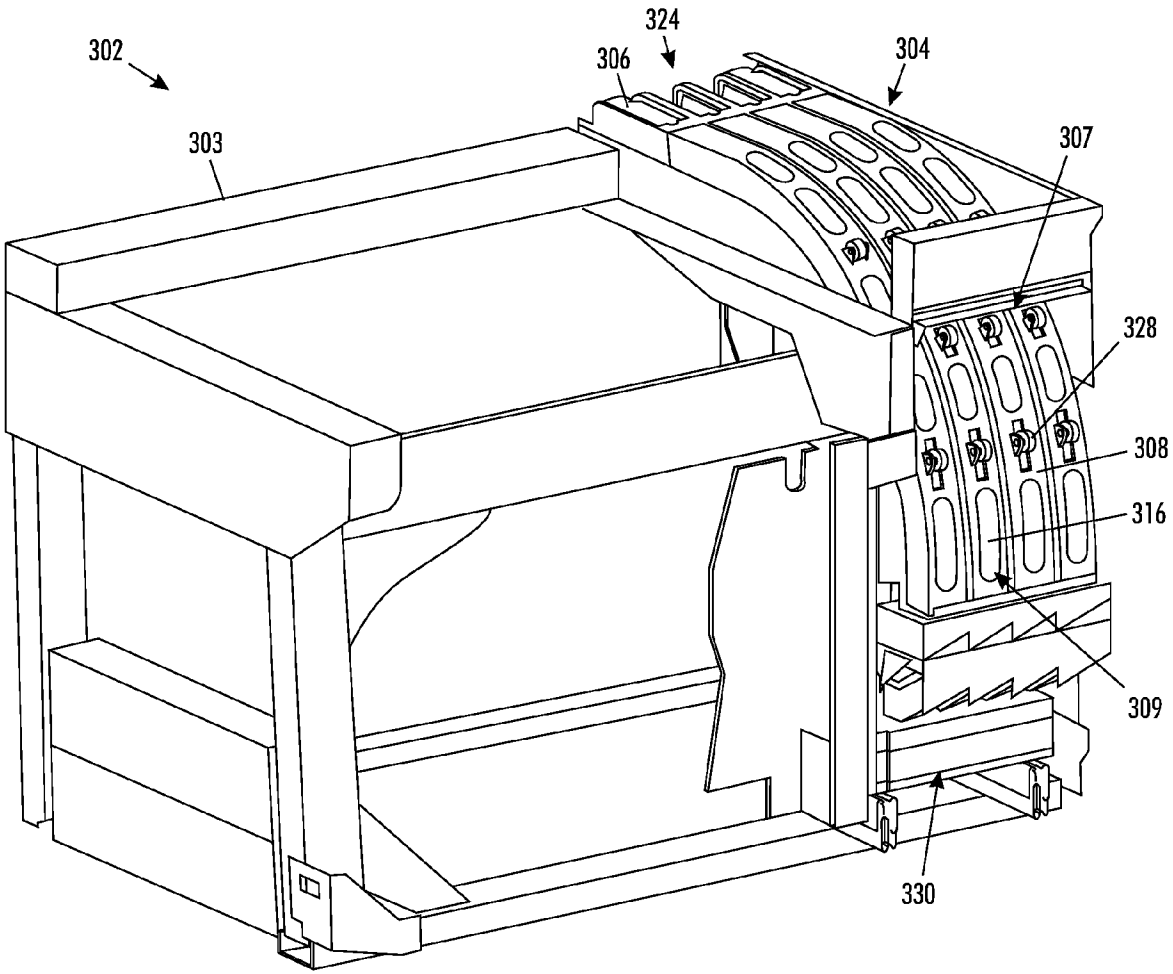
FIG. 12 is a partial cutaway perspective view of an embodiment of solid ink delivery system in position in a solid ink printer for delivering ink to print heads of the solid ink printer.

According to the system disclosed herein and referring now to FIG. 12, another embodiment of the printer with the solid ink delivery system of the system disclosed herein is shown as printer 302. The printer 302 is similar to the printer 202 of FIGS. 1-11 except that the printer 302 is a multi-color printer. The printer 302 utilizes four separate color ink sticks 306 which have respectively the colors black, cyan, magenta and yellow. The printer 302 of FIG. 12 also has a chute 308 which is different than the chute 208 of the printer 202 of FIGS. 1-11 in that the chute 308 includes an arcuate portion 307.

It should be appreciated that a solid ink color printer may be designed within the scope of the system disclosed herein without a chute having an arcuate portion. The arcuate portion 307 may be comprised of a single or multiple arc axes, including continuously variable 3 dimensional arc paths, any combination of which can be of any length relative to the full arcuate portion. The term arcuate refers to these and any similar, non linear configuration. An arcuate or partially arcuate chute may have any number of arcuate and linear portions.

The printer 302, as shown in FIG. 12, has a frame 303 which is used to support solid ink delivery system 304. The solid ink delivery system 304 advances the sticks 306 from loading station 324 near the top of the printer 302 to melting station 330 near the bottom of the printer 302. The solid ink delivery system 304 includes a plurality of feed chutes 308. A separate feed chute 308 is utilized for each of the four colors: namely cyan, magenta, black and yellow. The frame, such as 303, may be any structure which mounts or supports the guides and may at minimum be one or more brackets, couplings or attachments.

As shown in FIG. 12, the ink delivery system 304 may include longitudinal openings 309 for viewing the progress of the sticks 306 within the individual feed chutes 308 and also to reduce cost and weight. Nudging members 328 may be positioned along the chute 308 for nudging the sticks 306 against the belt 316.

Figure 13:
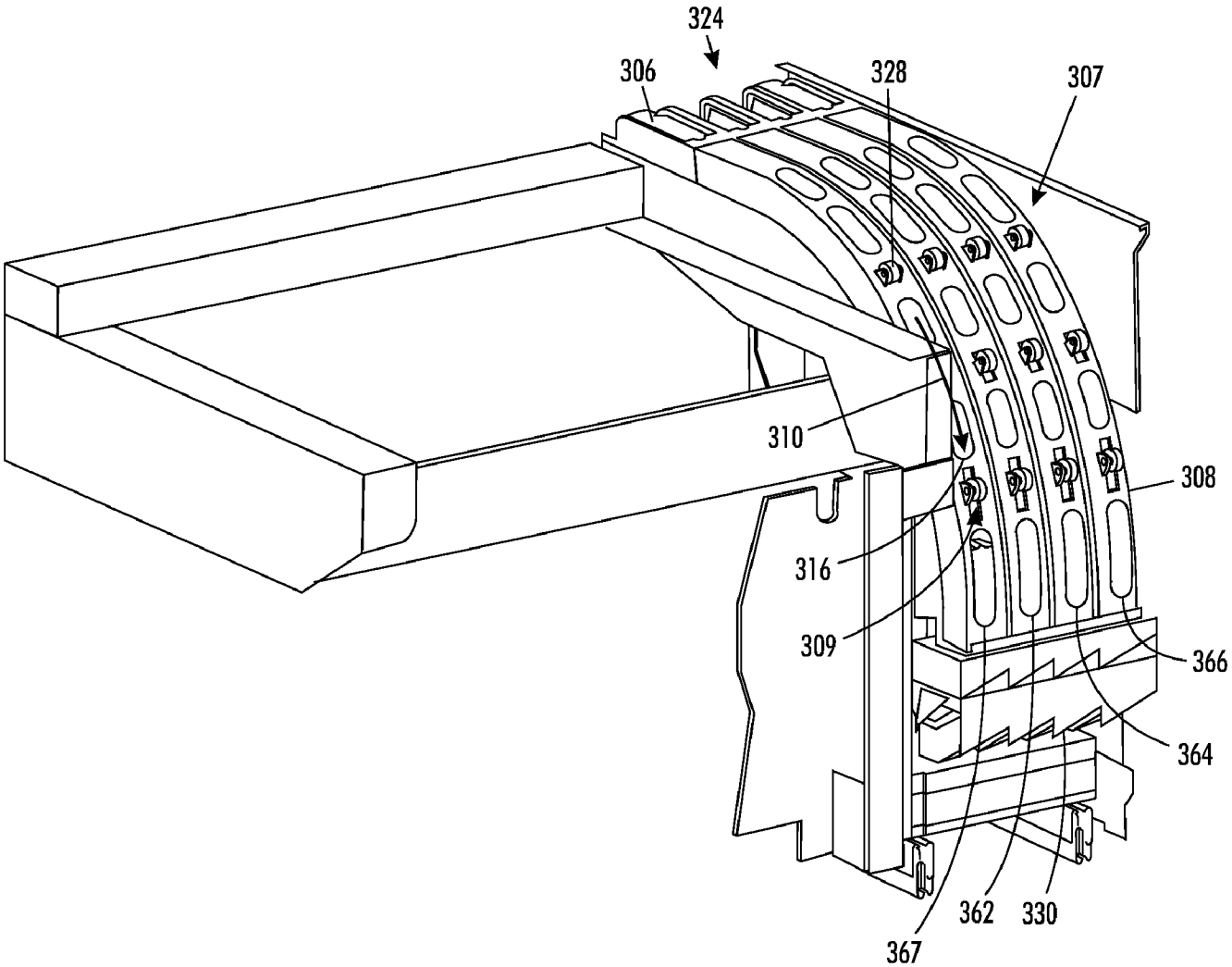
FIG. 13 is a partial cutaway perspective view of the solid ink delivery system of FIG. 12 in position in a solid ink printer for delivering ink to print heads of the solid ink printer, showing the ink delivery system in greater detail.

Referring now to FIG. 13, the solid ink delivery system of the printer is shown in greater detail. The solid ink delivery system incorporates four solid ink delivery sub-systems, each consisting, in part, of a load or receiving section, a feed chute and a melt unit. For example, and as is shown in FIG. 13, the solid ink delivery system includes a black solid ink delivery sub-system 361. The black ink delivery sub-system 361 is similar to the solid ink delivery system 204 of the printer 202 of FIGS. 1-6 except that the chute 308 of the black solid ink delivery sub-system 361 has an arcuate portion 307.

The solid ink delivery system further includes a second, third and fourth solid ink delivery sub-system 362, 364 and 366 providing for cyan, yellow and magenta ink sticks respectively. The colors have been described in a specific sequence but may be sequenced in any order for a particular printer. Keyed insertion openings define which color will be admitted into a sub-system color chute of the solid ink delivery system. Each of the solid ink delivery sub-systems 361, 362, 364 and 366 may be positioned parallel to each other and may have similar components. For simplicity, the black solid ink delivery sub-system 361 will be described in greater detail. It should be appreciated that the other sub-systems 362, 364 and 366 have similar components and operate similarly to the black solid ink delivery sub-system 361.

The black solid ink delivery sub-system 361 includes the chute 308 for holding a number of ink sticks 306 and guiding them in a prescribed path 310 from loading station 324 to the melting station 330. The chute 308 may have an insertion opening with any suitable shape such that only one color of the intended proper ink stick set may pass through the opening. The black solid ink delivery sub-system 361 further includes a drive member in the form of belt 316 which provides for simultaneous engagement with a plurality of the ink sticks 306 and extends along a substantial portion of the prescribed path 310 of the solid ink delivery sub-system 361.

Figure 14:
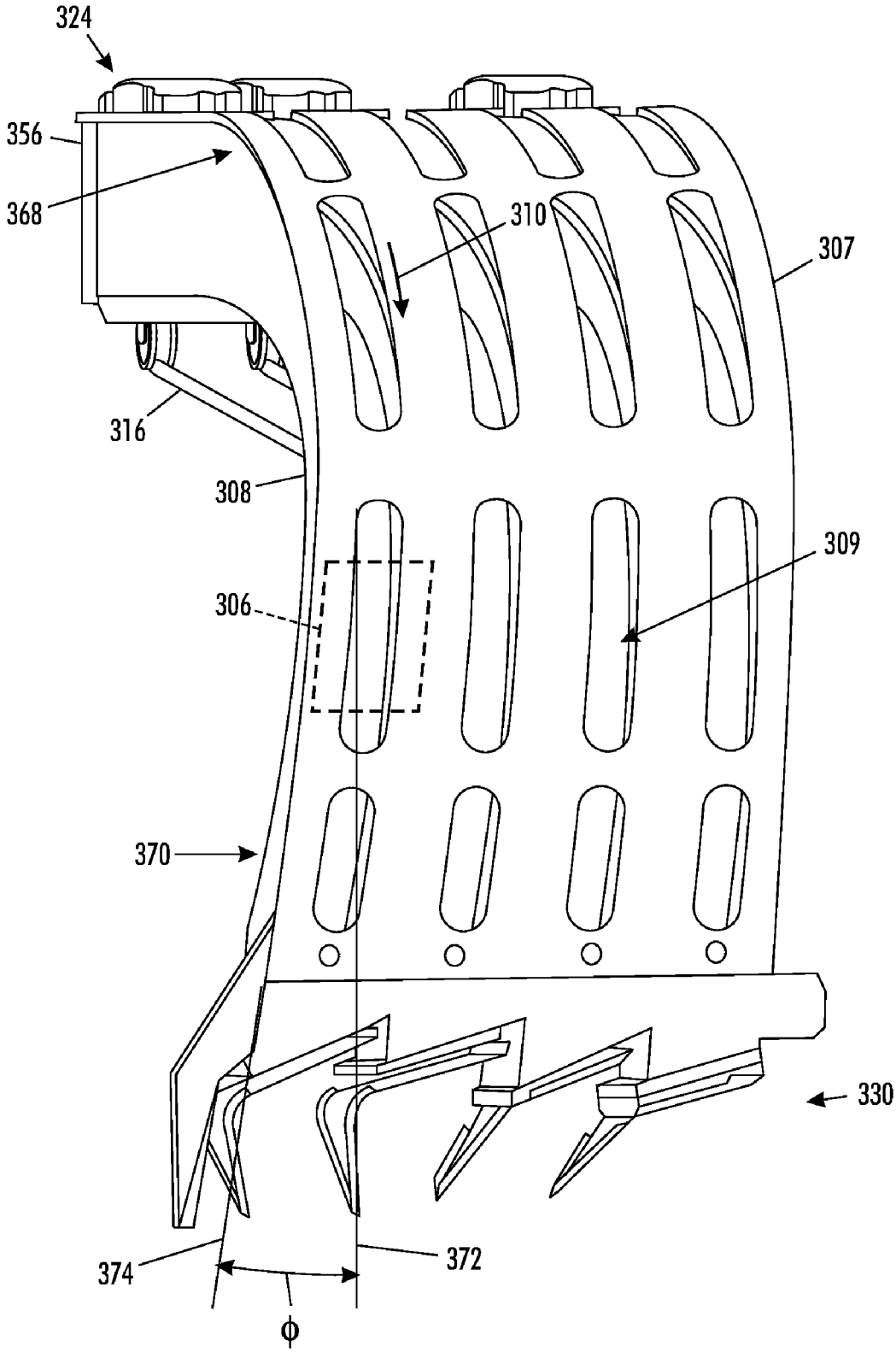
FIG. 14 is a perspective view of the guide for the ink sticks of the solid ink delivery system of FIG. 12 in position in a solid ink printer for delivering ink sticks to print heads of the solid ink printer.

While the chute 308 may have any suitable shape, for example, and as shown in FIG. 14, the chute 308 may include a first linear portion 368 adjacent the loading station 324. As shown in FIG. 14, the first linear portion 368 may be substantially horizontal such that the ink stick 306 may be inserted into the end 356 of the chute 308 in a simple horizontal motion in the top of the printer.

To better utilize the space within the printer, the chute 308 may have a shape that is not linear such that a greater number of ink sticks 306 may be placed within the printer than the number possible with a linear chute. For example, and as shown in FIG. 14, the chute 308 may include, in addition to the first linear portion 368, arcuate portion 307 extending downwardly from the first linear portion 368 of the chute 308. The chute 308 may further include a second linear portion 370 extending downwardly from the arcuate portion 307 of the chute 308. The second linear portion 370 may be substantially vertical and be positioned over the melting station 330 such that the ink sticks 306 may be delivered to the melting station 330 by gravity.

The chute may lay within a single plane, for example, plane 372. Alternatively, and as shown in FIG. 14, the chute 308 may extend through a series of non-parallel planes. For example, and as shown in FIG. 14, the chute 308 may move downwardly and outwardly to an angled plane 374 which is skewed with respect to the vertical plane 372. The planes 372 and 374 form an angle $\phi$ there between. The angle $\phi$ may be any angle appropriate to the printer requirements.

Figure 15:
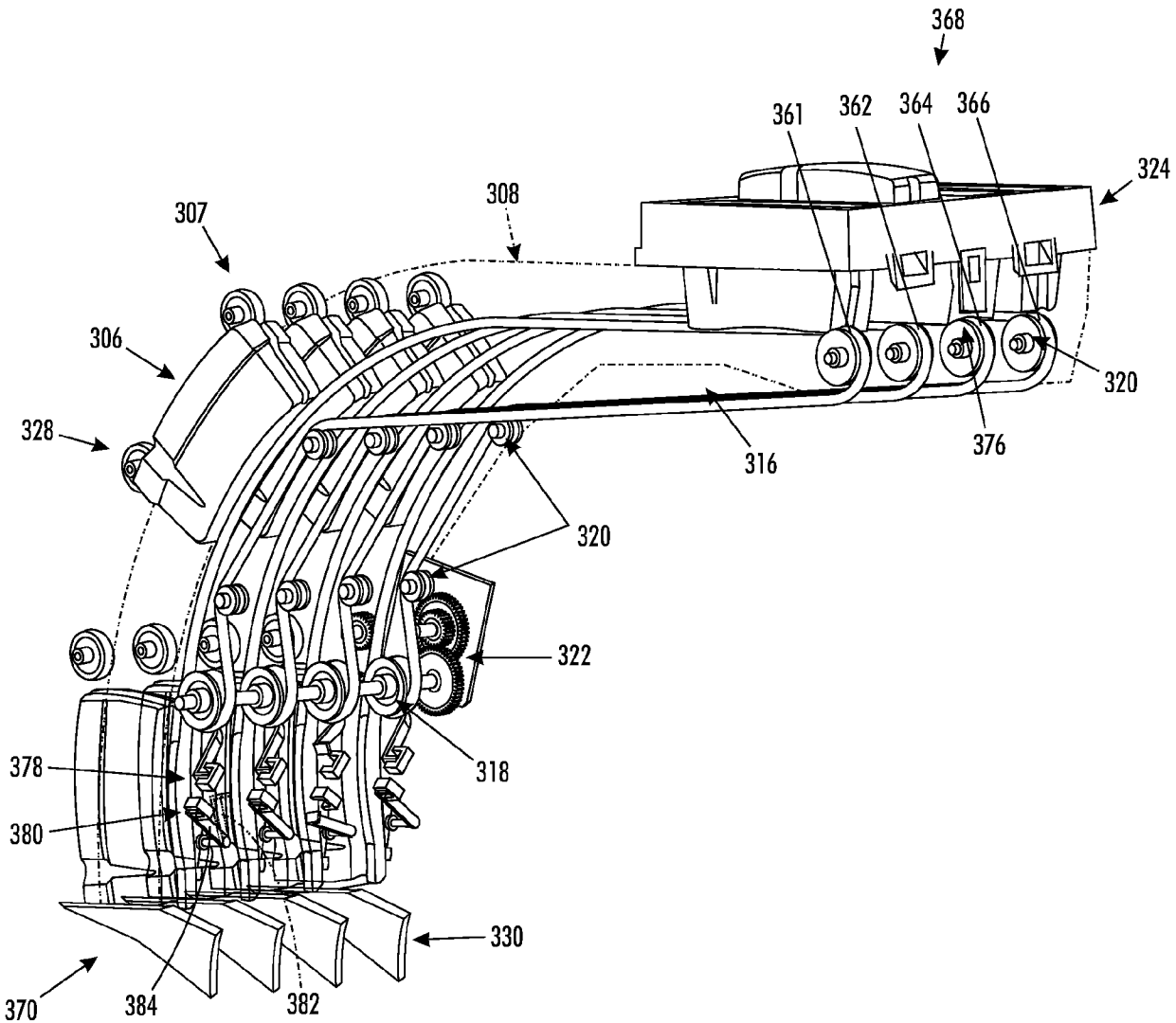
FIG. 15 is a perspective view of the guide assembly including the drive member for advancing the ink sticks of the solid ink delivery system of FIG. 12 toward the print heads of the solid ink printer.

Referring now to FIG. 15, the drive belt 316 of the solid ink delivery system of the printer is shown in greater detail. The drive belt 316 may require that a portion of the belt 316 have a shape to conform to the chute 308. The conforming shape may be in the arcuate portion 307 of the chute 308, as well as in the first linear portion 368 and the second linear portion 370 of the chute 308. The belt 316 may be driven, for example, by a motor transmission assembly 322 which is used to rotate drive pulley 318.

The drive belt 316 may for example have a circular cross section and be a continuous belt extending from the drive pulley 318 through a series of inlet idler pulleys 320 and chute 308. Nudging members 328 in the form of, for example, pinch rollers may be spring loaded or weight biased toward the belt 316 to assure sufficient friction between the belt 316 and the ink sticks 306 such that the ink sticks do not fall by gravity and slip away from the belt 316.

The solid ink delivery system of the printer may further include a series of sensors for determining the presence or absence of the ink sticks 306 within different portions of the chute 308. An inlet sensor assembly 376 may be used to indicate that additional ink sticks 306 may be added to the chute 308 when a previously inserted stick is advanced sufficiently. The inlet sensor assembly 376 may be positioned near loading station 324. A low sensor assembly 378 may be used to indicate a low quantity of ink sticks 306 in the chute 308. The low sensor assembly 378 may be positioned spaced from the melt station 330.

An out sensor assembly 380 may be used to indicate the absence of ink sticks 306 in the chute 308, excepting any remaining unmeltable ink volume. The out sensor assembly 380 may be positioned adjacent to the melt station 330. The sensor assemblies 376, 378 and 380 may have any suitable shape and may, for example, and as is shown in FIG. 15, be in the form of pivoting flags that pivot about a wall of the chute 308 and transition a switch, such as a micro switch or an optical interrupter.

The presence of a stick 306 causes the flags to move from first position 382, as shown in phantom, to second position 384, as shown in solid. A sensor or switch may be used to determine whether the flags 376, 378 or 380 are in the first position 382 or in the second position 384. Other sensing devices may be used in conjunction with or in place of a mechanical flag system, such as a proximity switch or reflective or retro-reflective optical sensor.

Figure 16:
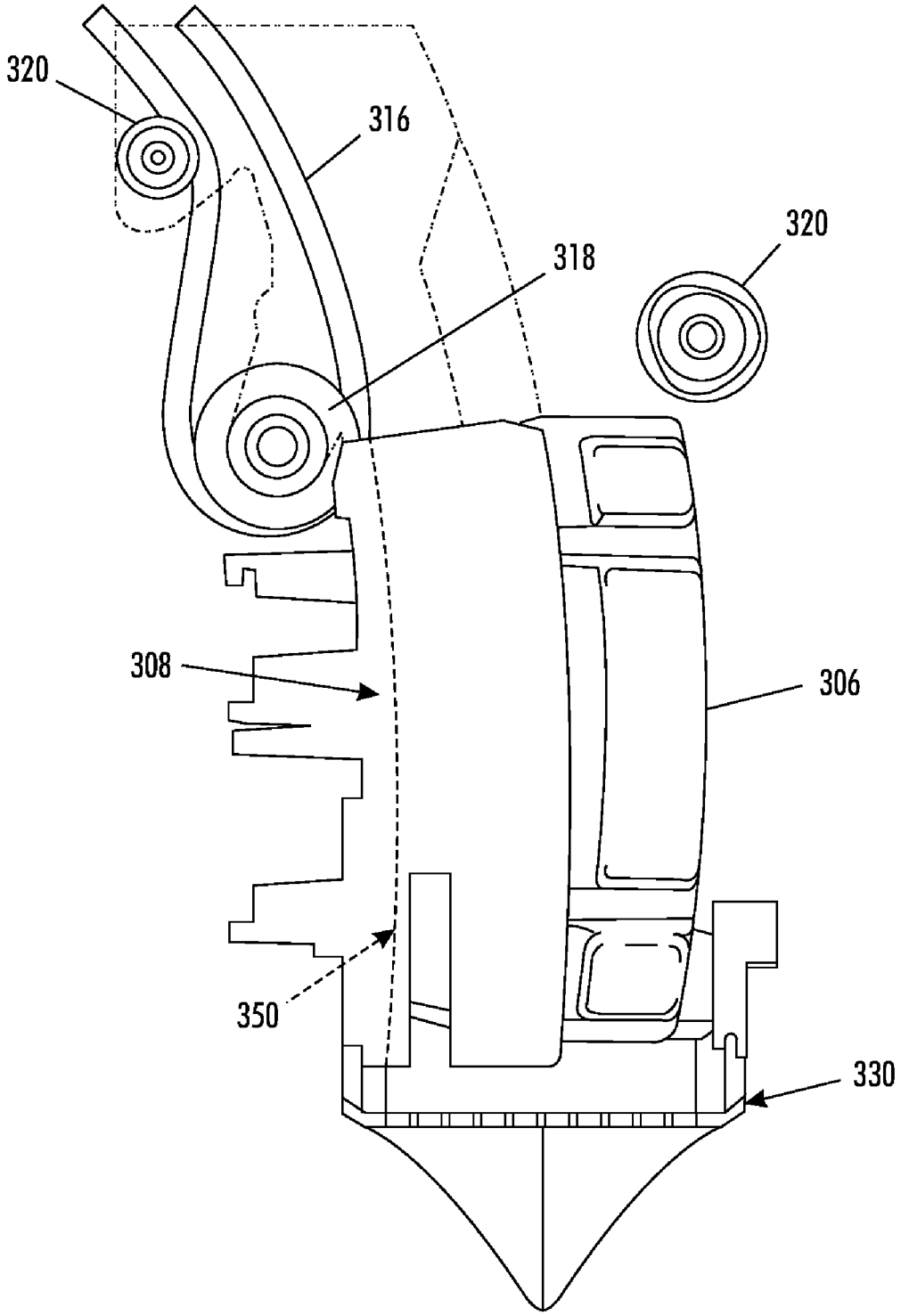
FIG. 16 is partial perspective view of the guide assembly including the drive member for advancing the ink sticks of the solid ink delivery system of FIG. 12 showing the portion adjacent the print heads in greater detail.

Referring now to FIG. 16, the solid ink delivery system of the printer is shown in the location around the melt station 330. As shown in FIG. 16, the drive pulley 318 and the belt 316 are positioned somewhat away from an ink stick 306 when the stick 306 is in the melt station 330. The spacing of the belt 316 away from the ink stick 306 when the ink stick 306 is in the melt station 330 may permit gravity to be the only factor causing the ink stick 306 to be forced against a melt unit when the belt is stopped. If the belt 316 continues to run, however, additional sticks 306, if present, may contact the belt 316 and push against the lower stick 306, urging it toward the melt station 330.

It should be appreciated that, alternatively, the pulley 318 may be positioned low enough that the ink stick 306 may be in contact with the pulley 318 when the stick 306 is in the melt station 330. With such configuration, the belt 316 may ensure sufficient forces are exerted on the ink stick 306 to maintain ink stick 306 contact against the melt unit.

Figure 17:
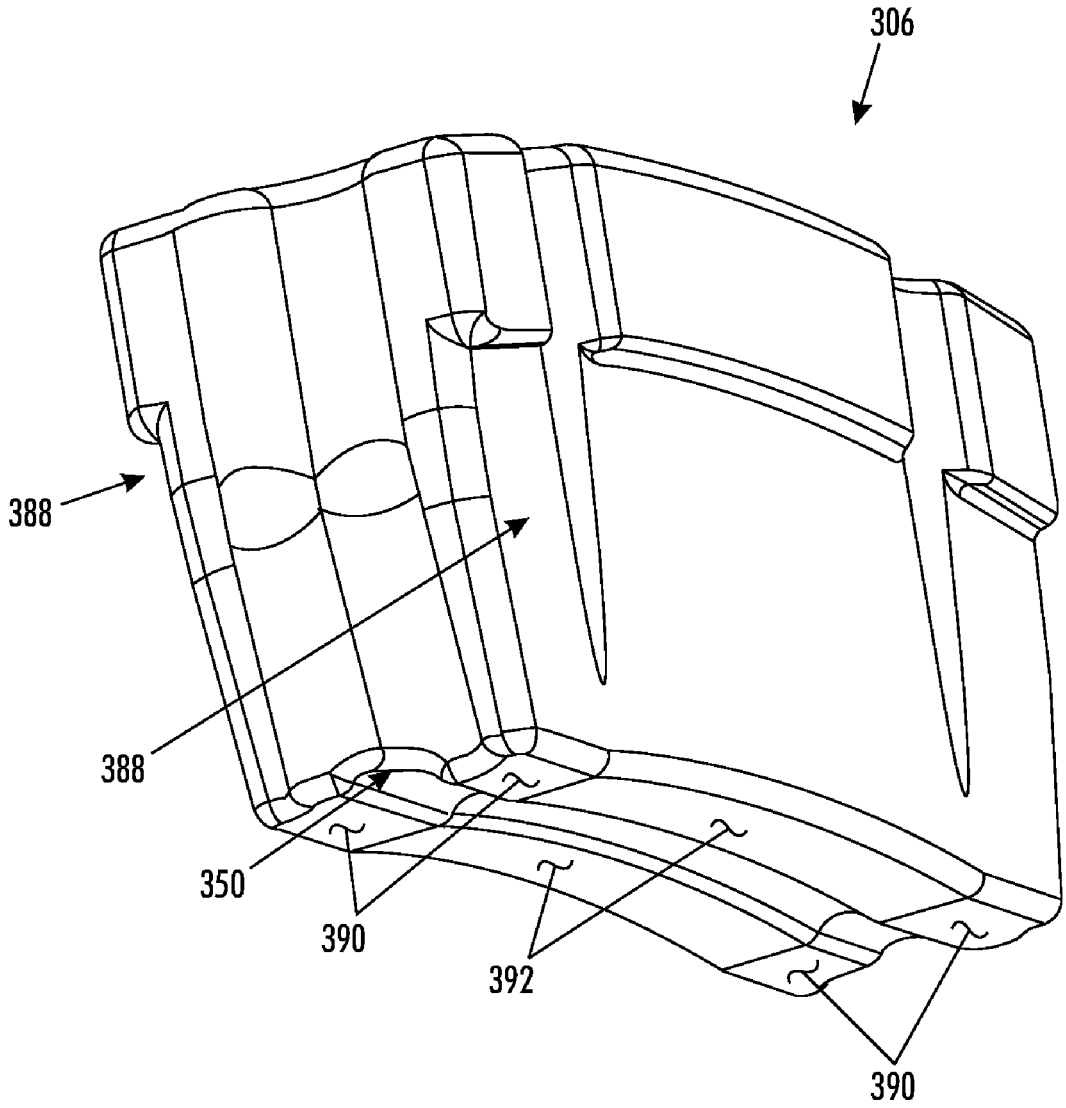
FIG. 17 is a perspective view of an ink stick for use with the guide assembly for advancing the ink sticks of the solid ink delivery system of FIG. 12 toward the print heads of the solid ink printer.

Referring now to FIG. 17, an ink stick 306 for use with the printer of FIGS. 7-11 is shown in greater detail. The ink stick 306 shown in FIG. 17 includes a series of vertical keying features used, among other things, to differentiate sticks of different colors and different printer models. The stick keying features are used to admit or block insertion of the ink through the keyed insertion opening of the solid ink delivery system. The ink stick 306 further includes a series of horizontal shaped features 388 for guiding, supporting or limiting feed of the ink stick 306 along a prescribed path of a chute (see FIG. 14). It should be appreciated that keying and shaped features can be configured to accomplish the same functions with a horizontal or other alternate loading orientation.

The ink stick 306, as shown in FIG. 17, includes two spaced-apart pairs of spaced-apart substantially flat underside surface portions 390, one pair on each end of the stick 306, for enabling the underside surface inset guide feature to be compatible with the linear portions of the ink feed path and guide, as well as a centrally located pair of spaced apart central inset arcuate portions 392, to similarly be compatible with the curved or arcuate portion of a guide and ink feed path. The ink stick groove 350 has linear and arcuate portions that essentially follow the contour or topography of the ink stick underside surface.

Figure 18:
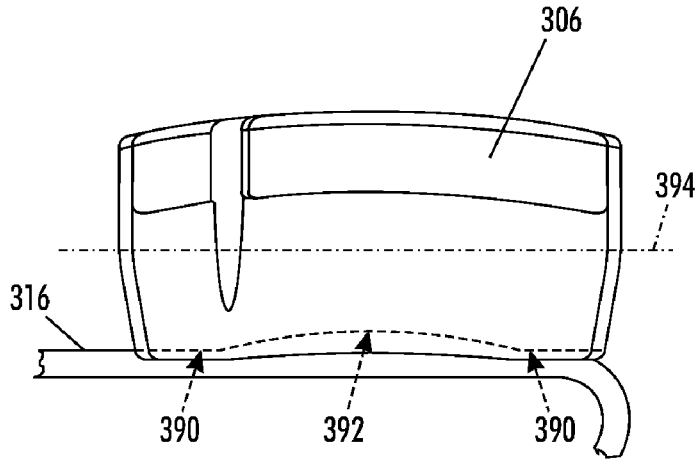
FIG. 18 is a plan view of the ink stick of FIG. 17 in position on a flat portion of the drive member of the solid ink delivery system of FIG. 12.

Referring now to FIG. 18, the ink stick 306 is shown in position on a linear portion of the belt 316 of a solid ink delivery system of a printer. The ink stick 306 contacts the belt 316 at portions of the surface formed into the underside portions 390 of the ink stick 306. Groove 350 (see FIG. 17)

formed in the ink stick 306 underside cooperates with the belt 316 to advance the stick 306. As shown in FIG. 18, the ink stick 306 is arcuate or curved along longitudinal axis 394.

Figure 19:
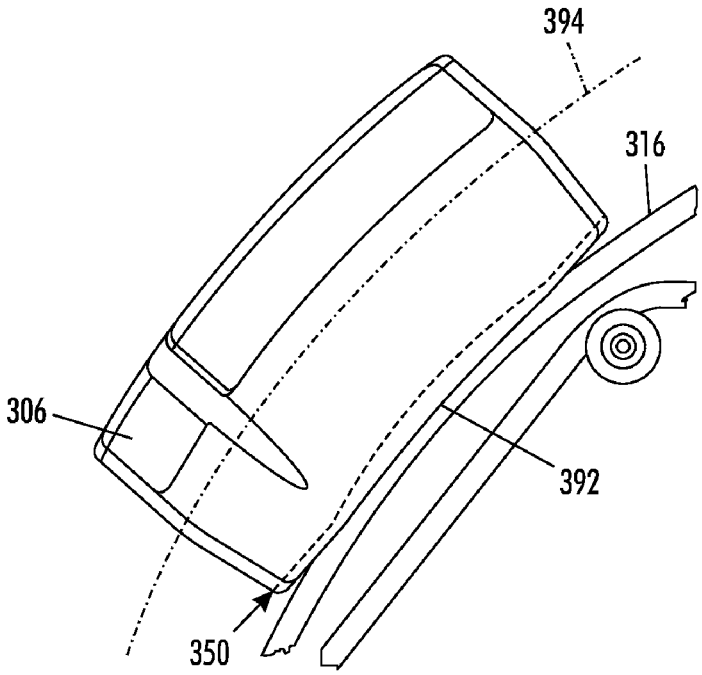
FIG. 19 is an plan view of the ink stick of FIG. 17 in position on a curved portion of the drive member of the solid ink delivery system of FIG. 12.

Referring to FIG. 19, the ink stick 306 is shown in position along an arcuate portion of the belt 316. As shown in FIG. 19, the central arcuate portion 392 of the ink stick 306 engages with the belt 316.

Figure 20:
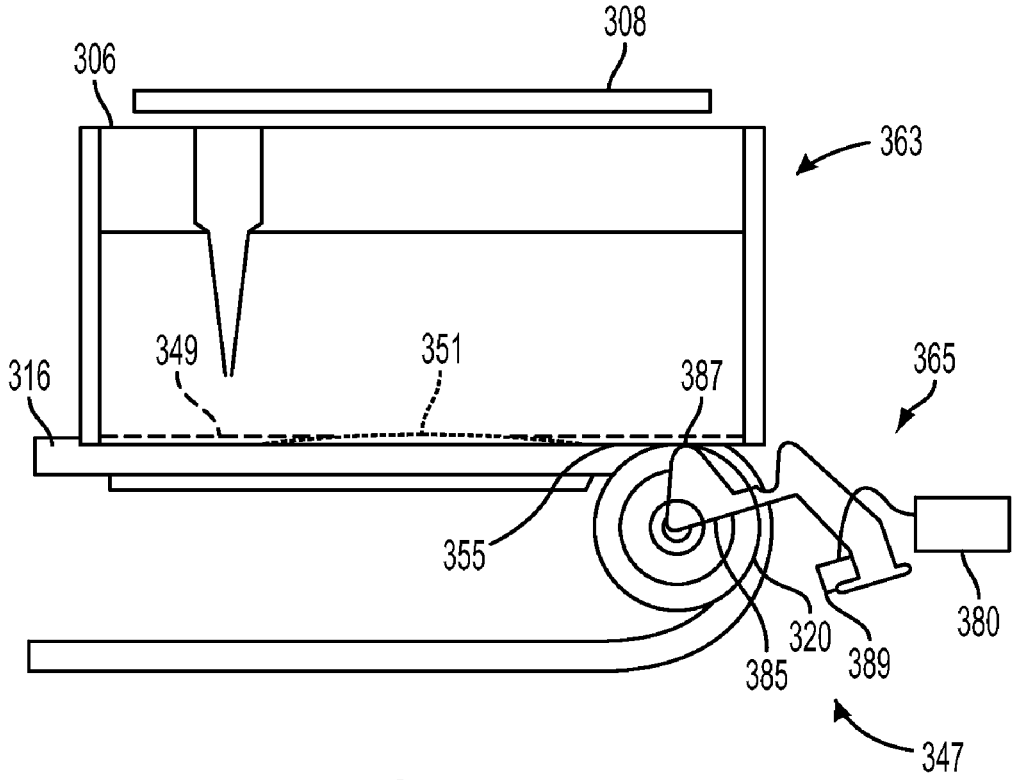
FIG. 20 is a partial plan view of the solid ink delivery system of FIG. 12 with a mechanical sensor showing the cooperation of the belt with a proper ink stick.

According to the system disclosed herein and referring now to FIG. 20, a stick validation system 347 for use in the solid ink delivery system of a printer is shown. The stick validation system 347 includes a guide 363 including, for example, chute 308 which is used to orient and guide proper ink sticks 306. The guide 363 further includes a drive member in the form of a belt 316. The belt 316 is guided by, for example, idler pulley 320. The stick validation system further includes a delivery system discrimination feature 349.

As shown in FIG. 20, the delivery system discrimination feature 349 may be in the form of the belt 316. The delivery system discrimination feature 349 cooperates with a stick discrimination feature, for example, stick discrimination feature 351 included in proper ink stick 306. As shown in FIG. 20, the stick discrimination feature 351 may be in the form of longitudinal groove. The longitudinal groove 351 cooperates and fits around belt 316.

As shown in FIG. 20, the stick validation system further includes a sensor 365 for sensing the presence of target surface 355 of the proper ink stick 306. As shown in FIG. 20, the target surface 355 is the underside surface of the proper stick 306. The underside surface 355 is positioned below groove 351 such that upper surface of the belt 316 is positioned above target surface 355 of the proper stick 306.

The sensor 365 may be any sensor capable of sensing the presence of target surface 355 of proper stick 306. For example and as shown in FIG. 20, the sensor 365 is in the form of a mechanical switch and includes a lever arm 385 including a contact surface 387 for contacting target surface 355 of the proper stick 306. The lever arm 385 of the sensor 365 is mechanically connected to, for example, a contact 389. The contact 389 may send an electrical signal to, for example, controller 380 to control the printer.

Figure 21:
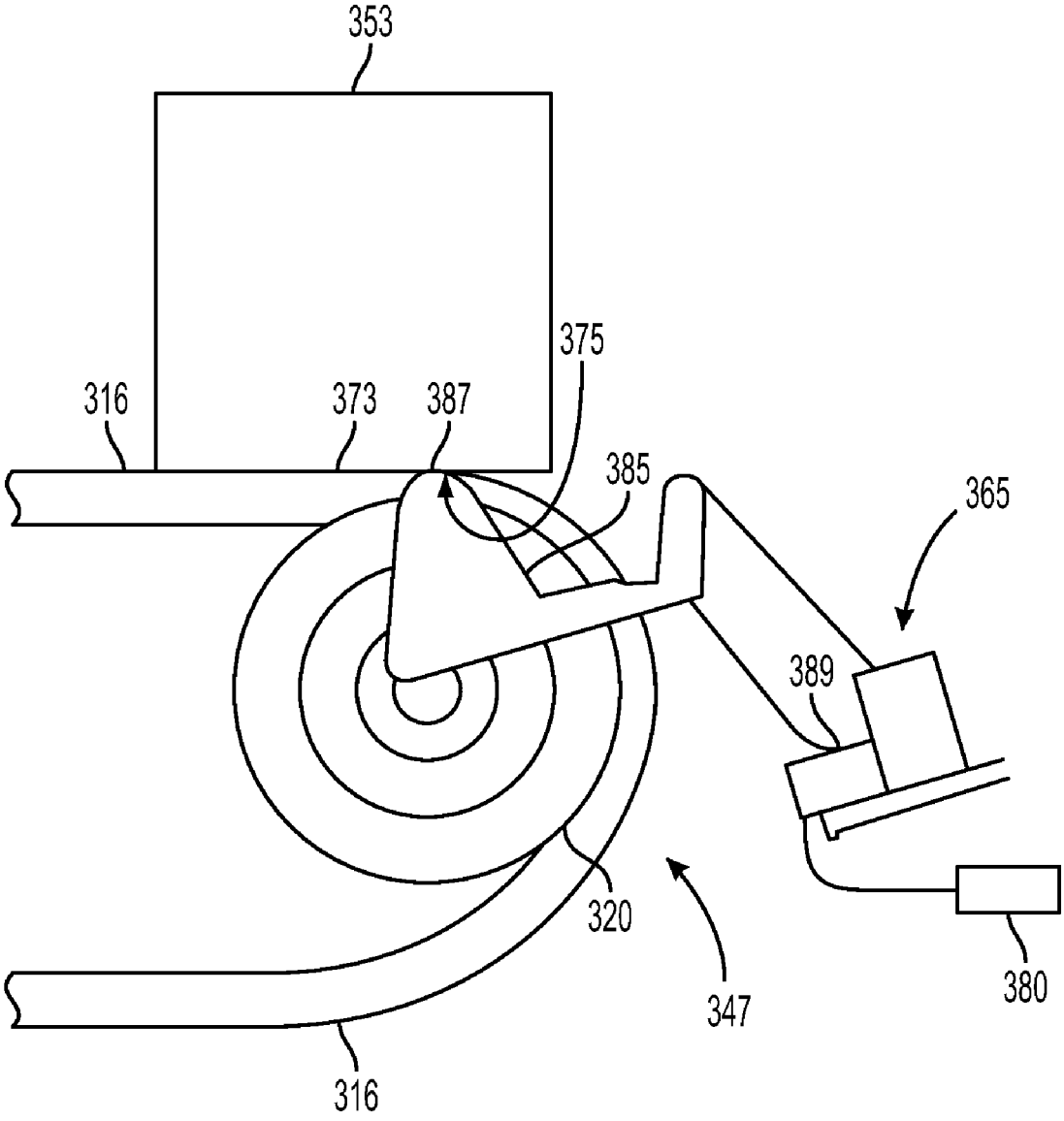
FIG. 21 is an enlarged partial plan view of the chute of FIG. 20.

Referring now to FIG. 21, the stick validation system 347 of the solid ink delivery system of a printer is shown with an improper stick 353 positioned in chute 308 of the guide 363 (see FIG. 20) of the solid ink delivery system. The improper stick 353 includes a lower end 375 that contacts contact point 387 of lever arm 385 of the sensor 365. The lower surface 375 of the improper stick 353 is in vertical alignment with upper end 373 of the belt 316.

As shown in FIG. 21, the lever arm 385 of the sensor 365 is positioned in a higher location when in contact with improper ink stick 353 than when in contact with proper ink stick 306 (see FIG. 20). In the higher position, as shown in FIG. 21, the sensor 365 sends a signal, to controller 389 to indicate that an improper stick 353 is located in the chute of the guide of the solid ink delivery system of the printer.

The improper stick 353, as shown in FIG. 21, is a rectangular ink stick 353. It should be appreciated that for sticks with more complex shapes, the chute and the guide should be optimized to be able to provide for the stick validation system 347 to accommodate or identify such an improper stick 353. It should be appreciated, further, that improper stick 353 may be urged against or confined near a horizontal wall such that lower surface 375 of the improper stick 353 is positioned in a relative horizontal plane such that the lever arm 385 when contacting the lower surface 375 of the improper stick 353 provides the proper signal to controller 389 to indicate the presence of improper stick 353.

In other words, if the improper stick 353 were to be positioned in a sufficiently skewed relationship in the chute, the lower surface 375 of the stick 353 may provide a false signal of a proper ink stick in the chute. If the lower surface 375 is urged into a relative horizontal position, the improper ink stick 353 may be more accurately identified. Any urging means, for example a spring, may be utilized to urge the improper stick 353 against or confine it near a vertical wall of the chute to properly orient the improper stick 353 for identification by the stick validation system 347.

Referring to FIGS. 20 and 21 the sensor 365 may, as shown, be positioned adjacent idler pulley 320. The position of sensor 365 adjacent idler pulley 320 may provide for a more reliable actuation of the sensor due to a more predictable spatial relationship.

Figure 22:
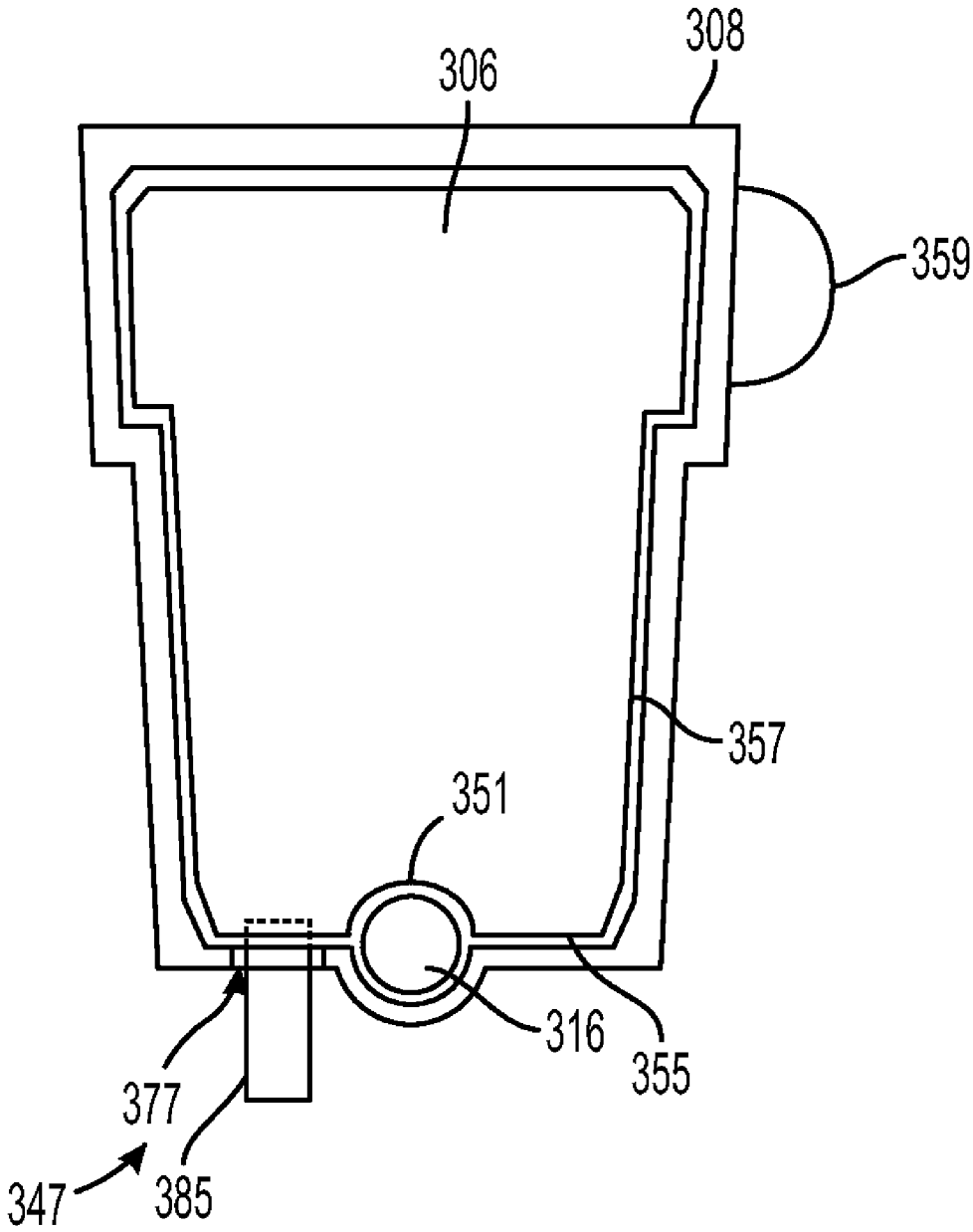
FIG. 22 is a partial end view, partially in cross section, of the chute of the solid ink delivery system of FIG. 12 with a mechanical sensor showing the cooperation of the belt and chute with a proper ink stick.

Referring now to FIG. 22, the stick validation system 347 of the system disclosed herein is shown with the proper ink stick 306 positioned in chute 308. The chute 308, as shown in FIG. 22, preferably closely conforms to the ink stick 306 so that the sensor 365 may properly contact target surface 355 of the proper ink stick 306. The chute 308 is connected to frame 359 of the printer. Periphery 357 of ink stick 306 has a complex shape and, as shown in FIG. 22, the chute 308 may, likewise, have a complex internal periphery complementary to the periphery 357 of the stick 306. It should be appreciated that conformity of the chute to the stick need not be completely around the stick or for the entire length of the chute, but only need be sufficient for proper guidance of the stick through the chute.

The chute 308 includes an opening 377 for permitting the lever arm 385 of the sensor 365 to pass through the chute 308 so that the lever arm 385 may contact target surface 355 of the ink stick 306. As shown in FIG. 22, the opening 377 may be positioned such that the target surface 355 of the ink stick 306 may be contacted by the sensor 365.

Figure 23:
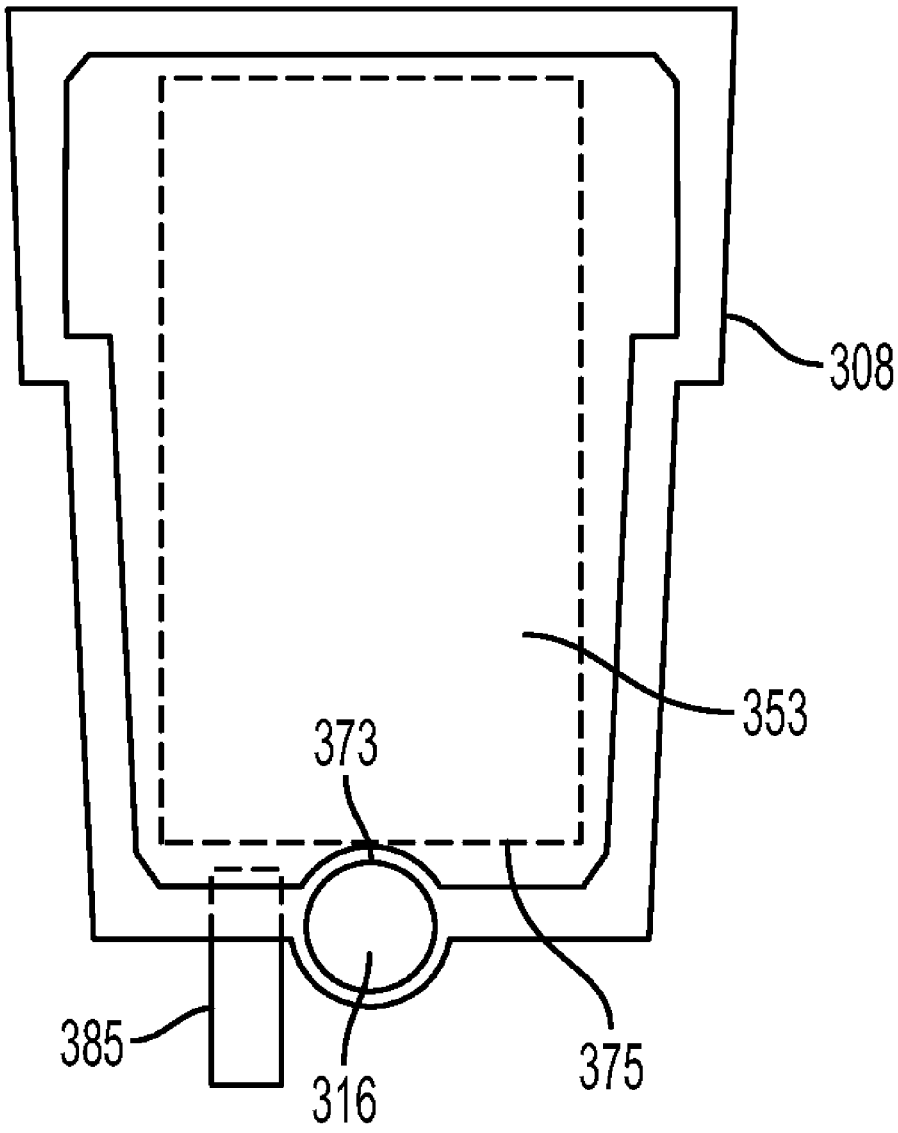
FIG. 23 is a partial end view, partially in cross section, of the chute of the solid ink delivery system of FIG. 12 showing the cooperation of the belt and chute with an improper ink stick.
Figure 24:
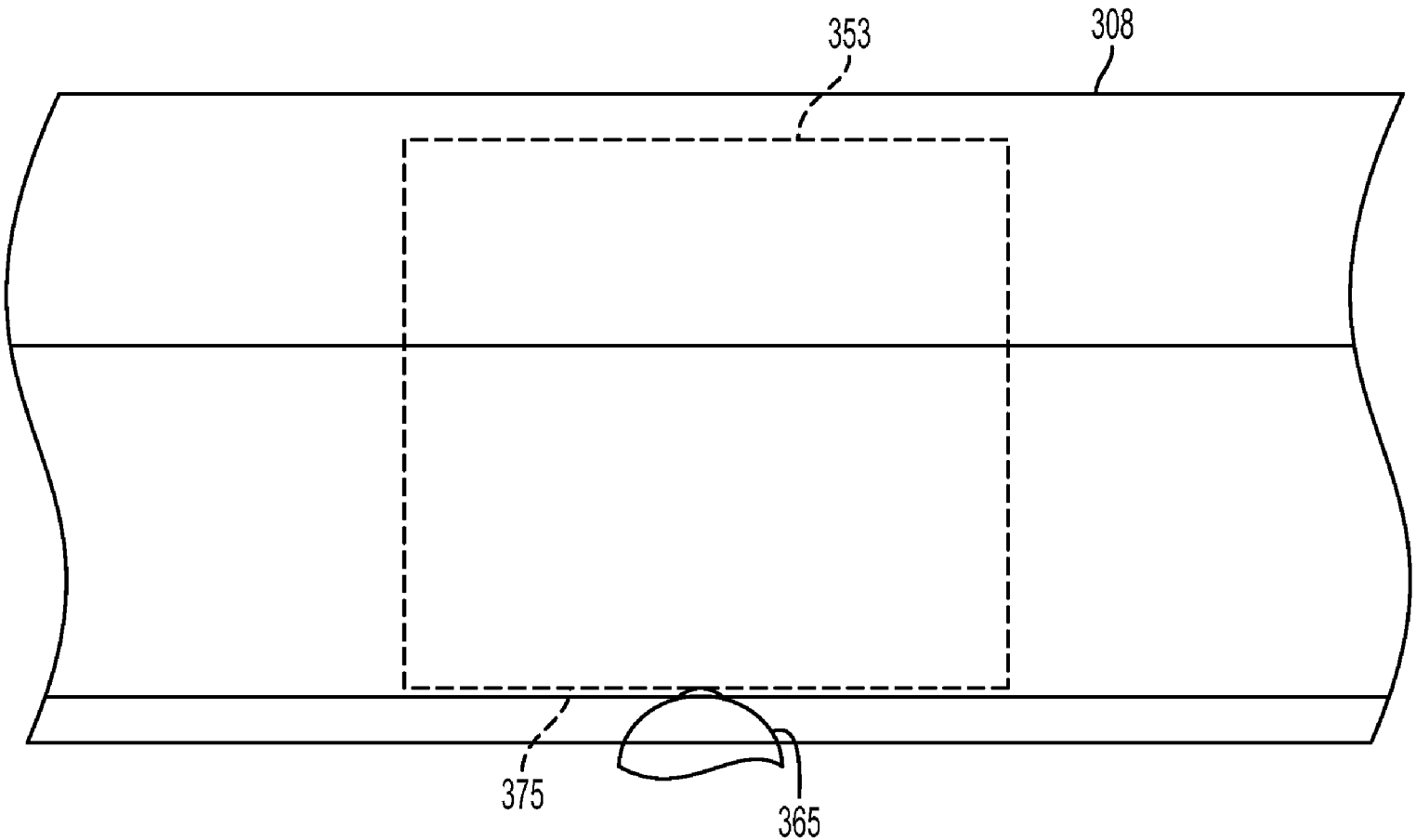
FIG. 24 is a partial plan view, partially in cross section, of the chute of FIG. 23.

Referring now to FIGS. 23 and 24, an improper ink stick 353 is shown in position in chute 308 of a solid ink delivery system. The improper stick 353 includes a lower surface 375 which is shown positioned at or above upper surface 373 of the belt 316. The sensor 365 is positioned such that arm 385 of the sensor 365 does not contact the improper ink stick 353, thus indicating that an improper ink stick 353 and not a proper ink stick is positioned in chute 308.

Figure 25:
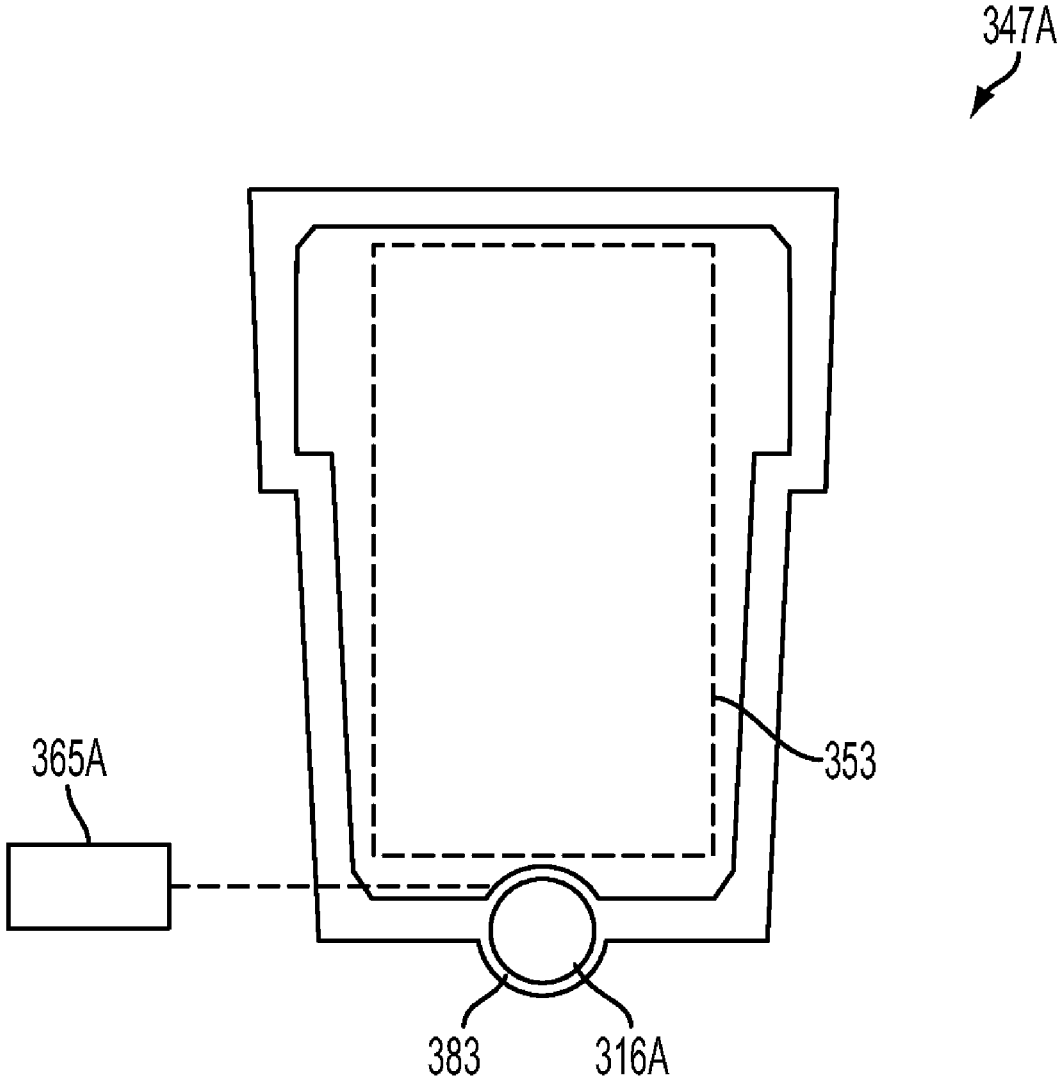
FIG. 25 is a partial end view, partially in cross section, of another embodiment of the system disclosed herein in the form of a chute with an electronic sensor showing the cooperation of the belt and chute with an improper ink stick.

Referring now to FIG. 25, yet another embodiment of the system disclosed herein is shown as stick validation system 347A. The stick validation system 347A is part of a solid ink delivery system of a printer. The stick validation system 347A is similar to the stick validation system of FIGS. 20-24, but includes a sensor 365A that is different than the sensor 365 of the stick validation system 347. The sensor 365A is an optical sensor and contacts reflective surface 383 of belt 316A.

Figure 26:
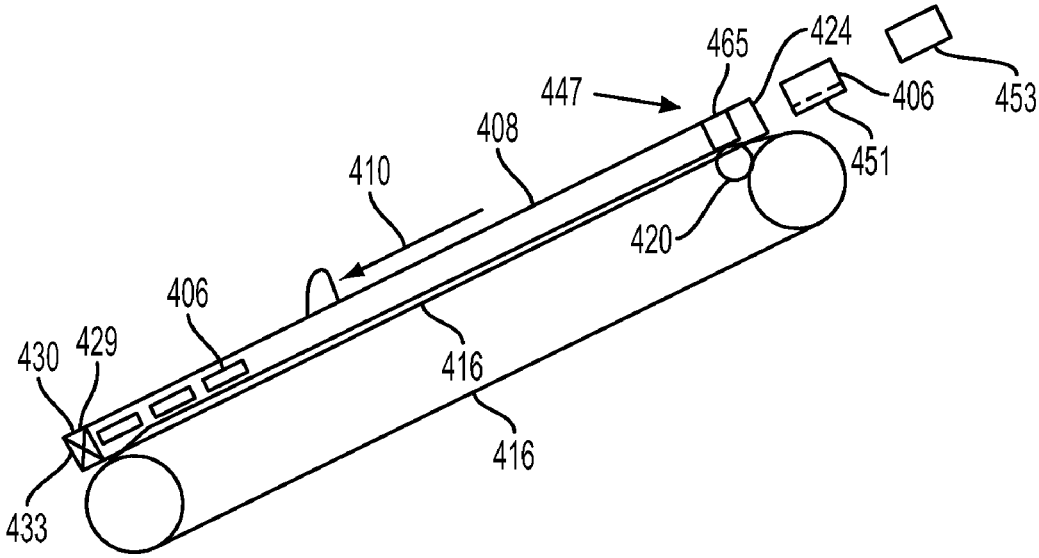
FIG. 26 is a cross sectional view of a chute with a drive member extending along the entire length of the chute of a solid ink delivery system for use in a printing machine according to another embodiment of the system disclosed herein.

Referring now to FIG. 26, the ink delivery system of a printer includes a chute 408 in which ink sticks 406 are designed to pass through. The chute 408 accommodates a plurality of the ink sticks 406. The ink sticks 406 are advanced from loading station 424 along prescribed path 410 to delivery station 429 adjacent melt station 430.

As shown in FIG. 26, the delivery system includes a drive member in the form of a belt 416 to urge the sticks 406 along prescribed path 410 to delivery station 429. The belt 416 extends from the loading station 424 to the delivery station 429 adjacent the melt station 430. The belt 416 thus urges the sticks 406 into the melt station 430 and against melting units 433.

According to the system disclosed herein and referring to FIG. 26, another embodiment of the system disclosed herein is shown as stick validation system 447 for use with the solid ink delivery system of printer. The stick validation system 447 includes a sensor 465 that is used to distinguish proper ink stick 406 from improper ink stick 453. The proper ink stick 406 includes a longitudinal groove 451 which mates with belt 416 to position the proper ink stick 406 such that the proper ink stick 406 may be distinguished by sensor 465 from improper ink stick 453. As shown in FIG. 26, the sensor 465 may be positioned adjacent belt idler 420 to provide for a more reliable sensor operation.

Figure 27:
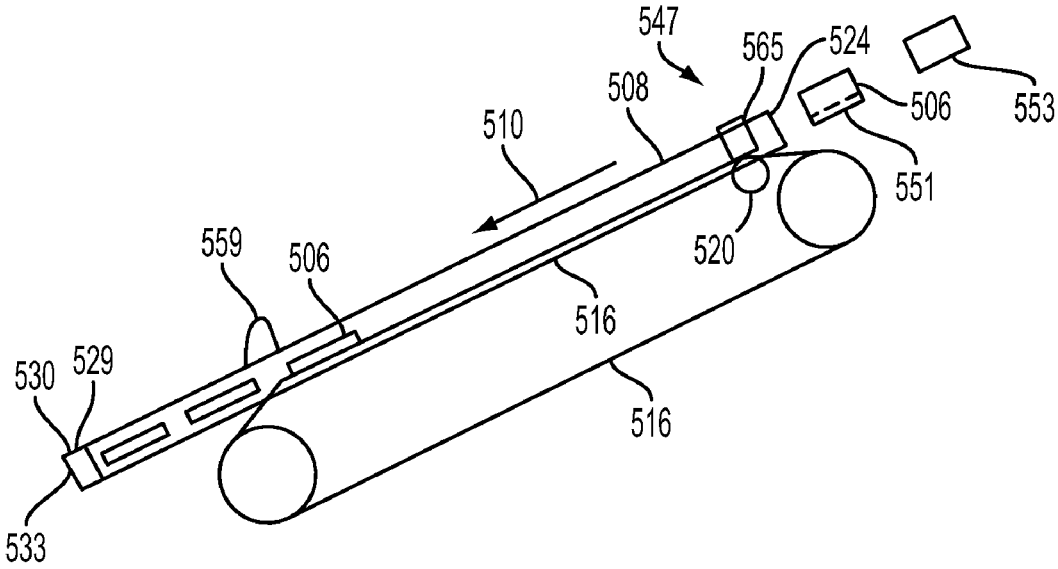
FIG. 27 is a cross sectional view of a chute with a drive member extending from the loading position of the chute to a position spaced from the delivery position of the chute of a solid ink delivery system for use in a printing machine according to another embodiment of the system disclosed herein.

Referring now to FIG. 27, yet another embodiment of the system disclosed herein is shown. The solid ink delivery system of a printer includes a chute 508 in which ink sticks 506 are designed to pass through. The chute 508 accommodates a plurality of the ink sticks 506. The ink sticks 506 are advanced from loading station 524 along prescribed path 510 to delivery station 529 adjacent melt station 530.

As shown in FIG. 27, the delivery system includes a drive member in the form of a belt 516 to urge the sticks 506 along prescribed path 510 to delivery station 529. The belt 516 extends from the loading station 524, but does not extend to the delivery station 529. The belt 516 ends before the delivery station 529. If the belt 516 continues to push the sticks 506 downwardly to the delivery station once a stick 506 has reached the end of the belt 516, it should be appreciated that the belt 516 may contribute to urge the sticks 506 into the melt station 530 and against the melting units 533, provided the ink stick stack length extends to the belt. If, however, the belt 516 is halted once a stick has reached the end of the belt, only gravity will urge full sticks or a portion of a stick that lies beyond the end of the belt into the melt station 530 and against the melting units 533 even if the ink stick stack length extends into the area of belt influence.

According to the system disclosed herein and referring now to FIG. 27, yet another embodiment of the system disclosed herein is shown as stick validation system 547 for use in the solid ink delivery system of a printer. The ink stick validation system 547 includes a sensor 565 which may, as shown in FIG. 27, be positioned adjacent idler pulley 520. The sensor 565 is used to distinguish proper ink stick 506 from improper ink stick 553.

The proper ink stick 506 includes a longitudinal groove 551 which mates with belt 516. The groove 551 and the belt 516 serve to position the proper ink stick 506 in a different relative position than improper ink stick 553 such that sensor 565 may be utilized to distinguish proper ink stick 506 from improper ink stick 553. The chute 508 may be secured to, for example, frame 559 of the printer.

Figure 28:
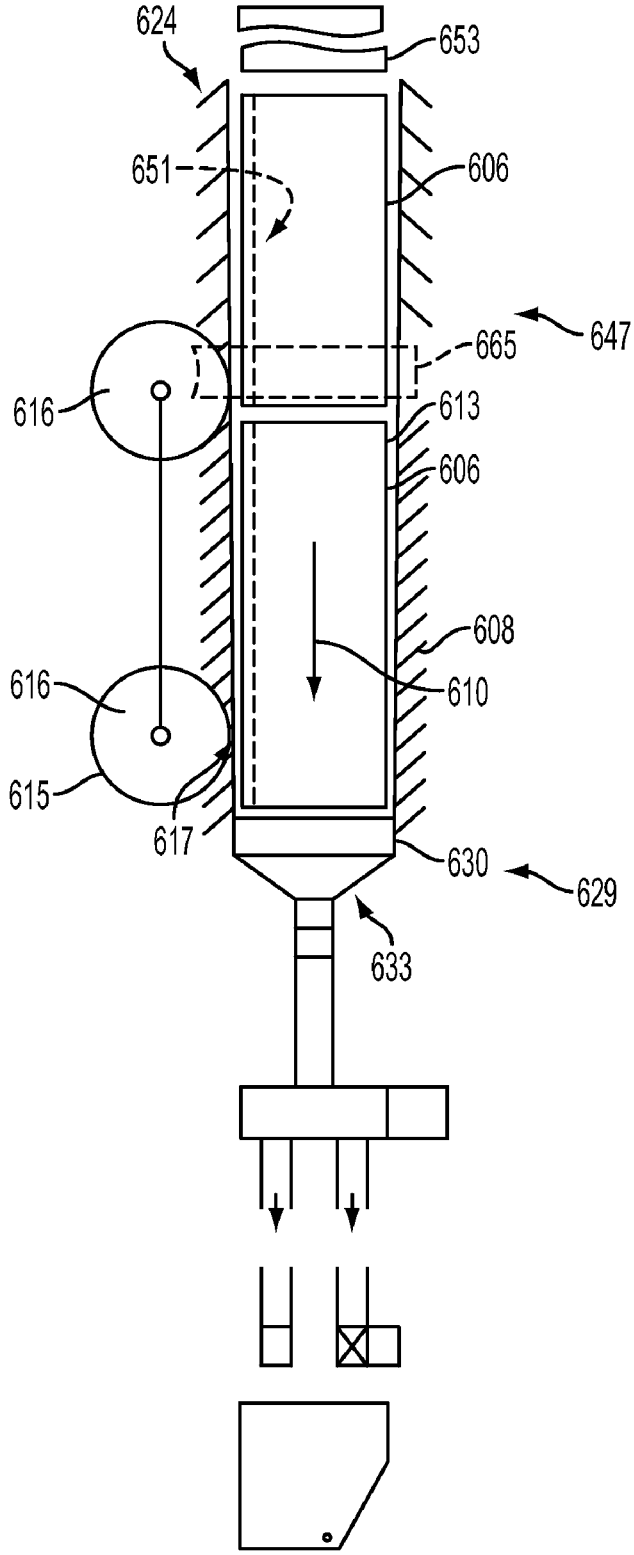
FIG. 28 is a schematic view of a solid ink delivery system for use in a printing machine according to another embodiment of the system disclosed herein.

Referring now to FIG. 28, yet another embodiment of the system disclosed herein is shown. The solid ink delivery system of a printer includes a chute 608 to which ink sticks 606 are designed to pass through. The chute 608 accommodates a plurality of the ink sticks 606. The ink sticks 606 are advanced from loading station 624 along prescribed path 610 to delivery station 629 adjacent melt station 630.

As shown in FIG. 28, the delivery system includes a drive member in the form of a series of wheels 616 to urge the sticks 606 along prescribed path 610 to delivery station 629. The wheels 616 have a periphery 615 that contacts exterior 613 of the sticks 606 and urges them from the loading station 624 to the delivery station 629. The wheels 616 may be small and confined within the chute 608 or be positioned mostly outside the chute 608 with an opening 617 in the chute 608 permitting the wheel 616 to contact the sticks 606. If the wheels 616 continue to push the sticks 606 downwardly to the delivery station 629 once a stick 606 has reached the end of the lowest wheel 616, it should be appreciated that the wheel 616 may contribute to urge the sticks 606 into the melt station 630 and against the melting units 633. If, however, the wheels 616 are halted once a stick 606 has reached the end of the wheels 616, only gravity will urge the bottom stick 606 into the melt station 630 and against the melting units 633.

Referring to FIG. 28, yet another embodiment of the system disclosed herein is shown as stick validation system 647 for use with a solid ink delivery system of a printer. The stick validation system 647, of FIG. 28, is different from the stick validation system 347 of FIGS. 20-24, in that the stick validation system 647 is utilized with a printer having a solid ink delivery system that does not utilize a belt. The stick validation system 647 is used with a solid ink delivery system which utilizes drive member 616 in the form of drive drums of discs. The drive member 616 is designed to matingly receive longitudinal groove 651 formed in ink stick 606. The stick validation system is utilized to differentiate proper ink stick 606 from improper ink stick 653. The improper ink stick 653 does not include a longitudinal groove.

The combination of the longitudinal groove 651 in the proper ink stick 606 and the drive member 616 provides for a different position for the proper ink stick 606 in the chute 608 from the position of the improper ink stick 653 in the chute 608. The stick validation system 647 distinguishes the position of the proper ink sticks 606 from that of the improper ink sticks 653 using a sensor 665 in a method similar to that of the stick validation system 347 of FIGS. 20-24.

Figure 29:
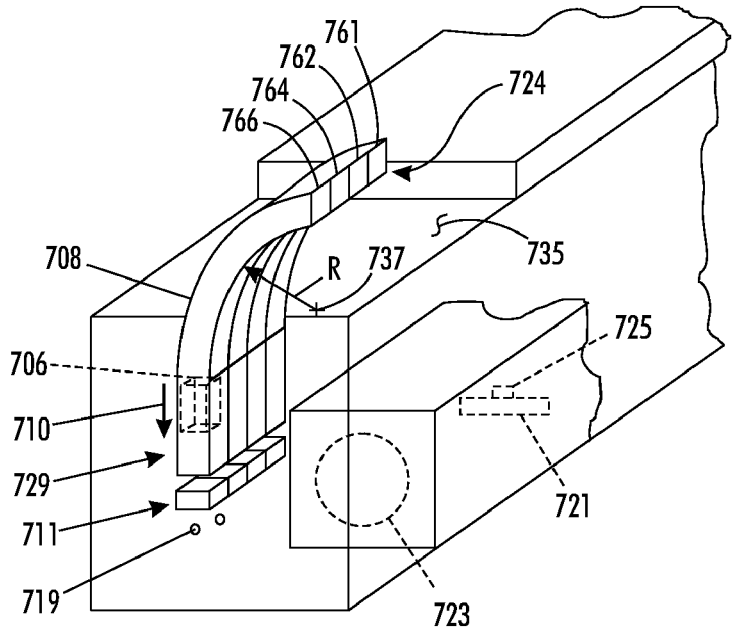
FIG. 29 is a partial perspective view of an embodiment of a solid ink delivery system for delivering solid ink stock to a melting station for converting the solid ink into liquid form for delivery to print heads of the printer.

According to the system disclosed herein and referring now to FIG. 29, a solid ink printer is shown. The printer includes a solid ink delivery system for use with an ink stick 706. The printer includes the ink delivery system for delivering the stick 706 to a melting station where a melting unit 711 is used to melt the stick 706. The ink in the stick 706 is transferred from a solid to a liquid and the liquid ink 719 is transferred to media, for example, a sheet of paper 721, by a drum 723 to form an image 725 on the paper 721. The ink delivery system includes a guide for guiding the stick 706 in a prescribed path 710. The guide may be, for example, in the form of a guide or chute 708. The chute 708 defines a loading station 724 to permit the stick 706 to be placed into the guide or chute 708. The chute 708 is configured to contain and guide the sticks along the feed path from insertion to melt unit.

The chute 708 also defines a delivery position 729 adjacent to the melting unit 711. The loading station 724 is located above the delivery position 729. The stick 706 is slideably fitted to the chute 708 where by only gravity advances the stick 706 from the loading station 724 to the delivery position 729.

It should be appreciated that the chute 708 may have any suitable shape such that the sticks 706 feeds by gravity from loading station 724, that may be positioned near, for example, the printer top work surface 735, toward the melting unit 711. The chute 708 may be linear or arcuate. The arcuate portion may be comprised of a single or multiple arc axes, including continuously variable 3 dimensional arc paths, any combination of which can be of any length relative to the full arcuate portion. The term arcuate refers to these and any similar, non linear configuration. For example the chute 708 may, as is shown in FIG. 29, be of a continuous arcuate shape defined by a radius R extending from the origin 737. It should be appreciated that origin 737 may be positioned anywhere with respect to the chute 708 and that the radius R may be constant, or, as is shown in FIG. 29, vary such that the radius R may increase such that the chute is virtually vertical near the melting unit 711.

The chute configuration examples shown in the various alternative embodiments are depicted as fully matching the ink shape at least in one sectional axis. The chute need not match the ink shape in this fashion and need not be completely encircling. One or more sides may be fully or partially open or differently shaped. The side surfaces of the chute do not need to be continuous over the chute length. The chute need only provide an appropriate level of support and/or guidance to complement reliable loading and feeding of ink sticks intended for use in any configuration.

Figure 30:
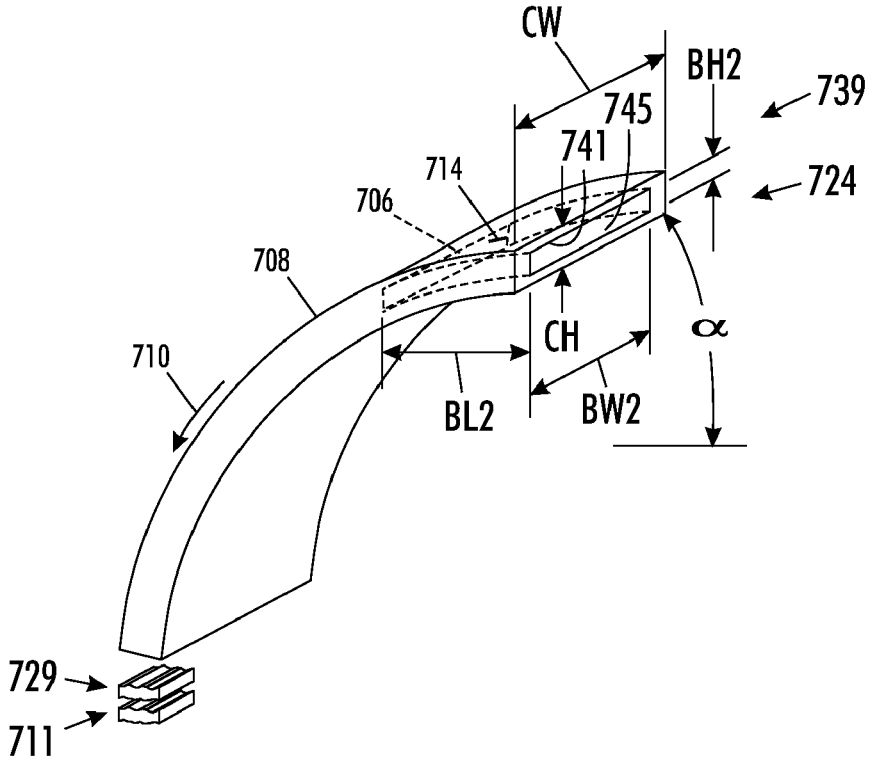
FIG. 30 is a partial plan view of the chute of the solid ink delivery system of FIG. 29.

Referring now to FIG. 30, it should be appreciated that the chute 708 forms a stick opening 739 in a suitable size and shape and to provide for the uniform movement of the sticks 706 down the chute 708 along the path 710. To avoid cross loading or jamming of the sticks 706 in the chute 708, the sticks 706 may have an external periphery 714 which closely conforms with internal periphery 741 formed in the stick opening 739 of the chute 708.

For example, and as is shown in FIG. 30, the sticks 706 may be rectangular and the stick opening 739 of the chute 708 may be rectangular and slightly larger than the sticks 706 to provide the ability of the sticks 706 to feed by gravity down the chute 708. For example, and as shown in FIG. 30, the sticks have a stick length BL2, a stick height BH2, and a stick width BW2. The stick opening 739 of the chute 708 may be defined by a chute height CH slightly larger than the stick height BH2 and a chute width CW slightly wider than the stick width BW2.

Further to assure that the sticks 706 feed by gravity down the opening 739 of the chute 708 and as is shown in FIG. 30, the bottom surface 745 of the stick opening 739 may form an angle $\alpha$ with the horizontal plane such that the force of gravity may exceed the coefficient of friction between the sticks 706 and the chute bottom surface 745 such that the sticks advance along the path 710 from the loading station 724 to the delivery position 729. Friction values are not definite and will vary based on numerous factors of a given system, such as stick size, stick to stick interfaces, angle of travel relative to gravity and so forth. A lubricious tape or similar non-stick surface may be applied to the bottom surface 745 to minimize friction.

Referring again to FIG. 29, the printer is a color ink printer. The chute 708 includes a first black chute 761, a second cyan ink chute 762, a third magenta ink chute 766, and a fourth yellow ink chute 764. The four ink chutes 761, 762, 764 and 766 may each have their respective keys to provide for the entry of only the proper ink stick. The colors have been described in a specific sequence but may be sequenced in any order for a particular printer. Keyed insertion openings define which color will be admitted into a particular color chute. It should be appreciated that the printer of the system disclosed herein may be a black or mono-chrome printer having one or more solitary chutes with partial or no gravity feed.

Figure 31:
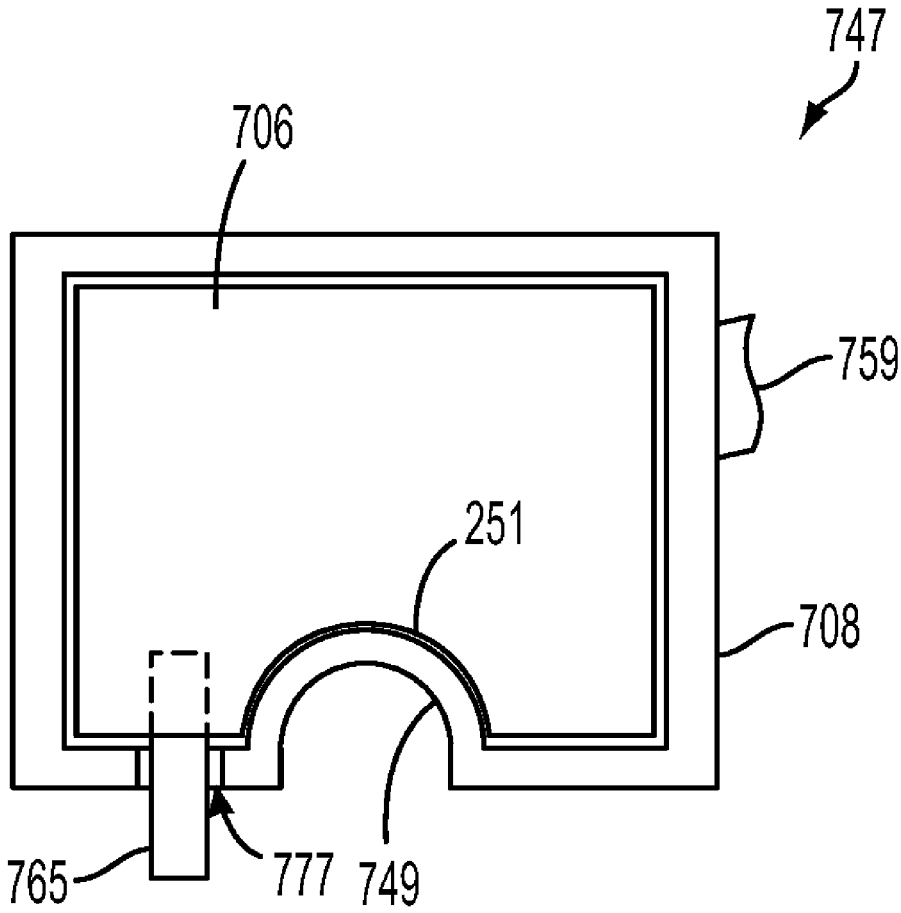
FIG. 31 is a partial end view, partially in cross section, of the chute of the solid ink delivery system of FIG. 29 with a mechanical sensor showing the cooperation of the belt and chute with a proper ink stick.

Referring now to FIG. 31, yet another embodiment of the system disclosed herein is shown as stick validation system 747 for use in solid ink delivery system of a printer. The stick validation system 747 of FIGS. 29-31 is different than the stick validation system 347 of FIGS. 20-24 in that the stick validation system 747 is utilized with the solid stick delivery system which does not utilize a belt. The stick validation system is utilized with an ink delivery system which utilizes gravity to advance sticks 706 along chute 708.

The stick validation system 747, as shown in FIG. 31, includes a chute 708 which is connected to frame 759 of the solid ink printer. The stick validation system 747 includes a solid stick delivery system discrimination feature 749 in the form of an internal protrusion formed in chute 708. The protrusion 749 has a generally semi-circular shape that is designed to conform with longitudinal groove 751 formed in proper ink stick 706.

A sensor 765 is positioned in a similar position to that of sensor 365 of the stick validation system 347 of FIGS. 20-24 and the sensor 765 is used to distinguish a proper ink stick 706, which contains a longitudinal groove 751, from an improper ink stick 753. The chute 708 of the solid ink delivery system includes an opening 777 for receiving sensor 765.

Figure 32:
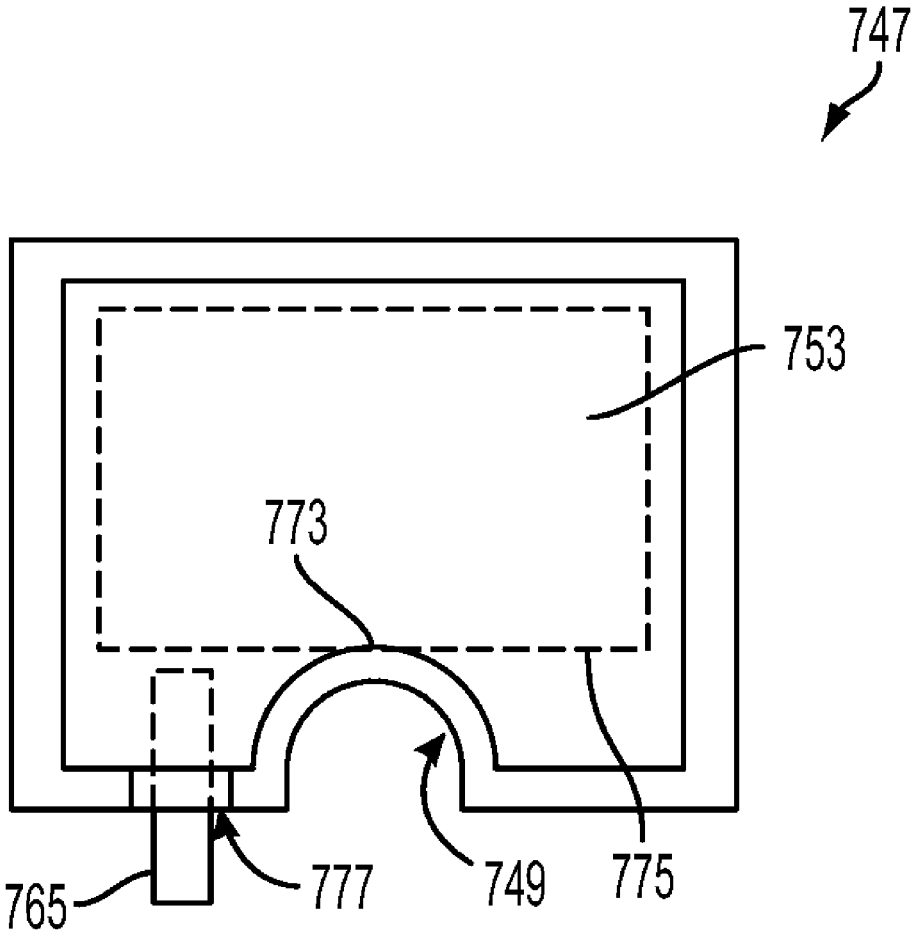
FIG. 32 is a partial end view, partially in cross section, of the chute of the solid ink delivery system of FIG. 29 showing the cooperation of the belt and chute with an improper ink stick.

Referring now to FIG. 32, the stick validation system 747 is shown with improper ink stick 753 positioned in chute. The improper ink stick 753 includes an underside surface 775 which is positioned above upper end 773 of protrusion 749. The position of the underside surface 775 above the protrusion 749 provides for having the sensor 765 being positioned below the underside surface 775 of the improper ink stick 753. The positioning of the sensor 765 below the improper ink stick 753 permits the sensor 765 to indicate that an improper ink stick 753 rather than proper ink stick 706 is positioned in chute.

It should be appreciated that any of the solid ink printers may include a drive member in the form of a belt or wheel that may be configured such that the belt or wheels are controlled by a reversing motor such that the sticks may be urged in a backward direction up the chute. The reversing motor configuration may be utilized to unload the sticks from the delivery system and to clear jams.

Variations and modifications of the system disclosed herein are possible, given the above description. However, all variations and modifications which are obvious to those skilled in the art to which the system disclosed herein pertains are considered to be within the scope of the protection granted by this Letters Patent.

What is claimed is:

1. A solid ink delivery system in a solid ink printer, said ink delivery system comprising:

a frame in a solid ink printer;

a heater for melting solid ink sticks;

a guide operatively connected to the frame and configured to have a width and a height approximately equal to a width and a height for an ink stick to enable the guide to direct ink sticks along a length of the guide to the heater, said guide further comprising a drive member configured to be received in a complementary inset drive engagement feature in an ink stick in the guide to enable an upper surface of the drive member to be above a lower surface of the ink stick as the drive member moves along a portion of the guide;

a sensor is positioned proximate the drive member and configured to detect whether a complementary inset drive engagement feature in an ink stick in the guide received the drive member by detecting a presence or an absence of a portion of the ink stick extending from an area below the upper surface of the guide to the lower surface of the ink stick; and a controller coupled to the sensor to control the solid ink printer in response to the sensor detecting whether the complementary inset drive engagement feature in the ink stick in the guide received the drive member.

2. The solid ink delivery system of claim 1:

the drive member further comprises an endless belt configured to travel endlessly along at least a portion of the length of the guide and sized to enable about half of the upper cross-section area of the endless belt to be received in the complimentary inset drive engagement feature of the ink stick.

3. The solid ink delivery system of claim 1, said sensor further including a member for contacting the portion of an ink stick that extends below the upper surface of the drive member.

* * * * *